US010066627B2

(12) United States Patent
Choudhuri

(10) Patent No.: US 10,066,627 B2
(45) **Date of Patent: *Sep. 4, 2018**

(54) AXIAL-FLOW PUMPS AND RELATED METHODS

(71) Applicant: Board of Regents, The University of Texas System, Austin, TX (US)

(72) Inventor: Ahsan Choudhuri, El Paso, TX (US)

(73) Assignee: BOARD OF REGENTS, THE UNIVERSITY OF TEXAS SYSTEMS, Austin, TX (US)

( * ) Notice: Subject to any disclaimer, the term of this patent is extended or adjusted under 35 U.S.C. 154(b) by 465 days.

This patent is subject to a terminal disclaimer.

(21) Appl. No.: 14/943,899

(22) Filed: Nov. 17, 2015

(65) Prior Publication Data

US 2016/0138596 A1 May 19, 2016

Related U.S. Application Data

(63) Continuation of application No. 13/194,529, filed on Jul. 29, 2011, now Pat. No. 9,909,588.

(60) Provisional application No. 61/369,525, filed on Jul. 30, 2010.

(51) Int. Cl.

| | |
|---|---|
| ***F04D 13/04*** | (2006.01) |
| ***F04D 3/00*** | (2006.01) |
| ***F04D 13/06*** | (2006.01) |
| ***F04D 29/52*** | (2006.01) |
| ***F04D 29/54*** | (2006.01) |

(52) U.S. Cl.

CPC ..... *F04D 13/04* (2013.01); *F04D 3/00* (2013.01); *F04D 13/0606* (2013.01); *F04D 29/528* (2013.01); *F04D 29/548* (2013.01)

(58) Field of Classification Search

CPC ..... F04D 13/04; F04D 3/00; F04D 13/0606; F04D 29/528; F04D 29/548

USPC ..... 415/211.2, 80, 83, 191, 193, 208.2, 415/209.1, 218.1

See application file for complete search history.

(56) References Cited

U.S. PATENT DOCUMENTS

| | | | | | |
|---|---|---|---|---|---|
| 3,406,632 | A * | 10/1968 | Duport | B63H 25/46 | 415/142 |
| 3,464,357 | A * | 9/1969 | Martin | B63H 25/46 | 114/151 |
| 3,993,015 | A * | 11/1976 | Klepacz | B63H 11/01 | 440/41 |
| 7,150,711 | B2 * | 12/2006 | Nusser | F04D 3/00 | 600/17 |
| 7,467,929 | B2 * | 12/2008 | Nusser | F04D 3/02 | 417/351 |
| 7,934,909 | B2 * | 5/2011 | Nuesser | F04D 3/02 | 310/90.5 |
| 2003/0228214 | A1 * | 12/2003 | McBride | B63H 11/08 | 415/191 |
| 2005/0175450 | A1 * | 8/2005 | Okubo | F01D 1/04 | 415/220 |

* cited by examiner

*Primary Examiner* — Aaron R Eastman
(74) *Attorney, Agent, or Firm* — Yee & Associates, P.C.

(57) ABSTRACT

Miniature (mesoscale) axial-flow pumps including an inlet guide, a stator spaced apart from the inlet guide, and a rotor rotatably disposed between the inlet guide and the stator.

22 Claims, 25 Drawing Sheets

| β1 | β`1 | i | β2 | β`2 | ii |
|---|---|---|---|---|---|
| 20 Deg. | 30 Deg. | 10 Deg. | 6 Deg. | -8 Deg. | 14 Deg. |

AXIAL-FLOW PUMPS AND RELATED METHODS

CROSS-REFERENCE TO RELATED APPLICATIONS

This patent application is a continuation of U.S. patent application Ser. No. 13/194,529, entitled "AXIAL-FLOW PUMPS AND RELATED METHODS," filed Jul. 29, 2011, which claims priority to U.S. Provisional Patent Application No. 61/369,525, filed Jul. 30, 2010, the entire contents of which are incorporated by reference.

GOVERNMENT SUPPORT

This invention was made with government support under MDA Grant No. HQ0006-05-C-0031, awarded by the Missile Defense Agency. The government has certain rights in the invention.

BACKGROUND

1. Field of the Invention

The present invention relates generally to axial-flow pumps and, more particularly, but not by way of limitation, to miniature axial-flow turbopumps such as may, for example, be used in miniature propulsion systems.

2. Description of Related Art

Pump-based propellant delivery systems have been used for propulsion engines where thrust values are greater than 50 kN. Technological limitations have largely prevented the development of miniature turbopumps. Such technical limitations include, for example, design challenges such as cavitation dynamics, throttling range and response time, mesoscale (sub-millimeter) manufacturing process, and inadequate design/analysis tools at smaller scales [1]. Generally, the relative importance of viscous effects (Reynolds number effects), rotor-stator clearances, surface roughness, measurement errors and misalignments increase as the size of the turbopump decreases [2-3]. Thus, scaling prediction becomes increasingly difficult at the millimeter scale. It is not clear whether presently available theories and design/analysis tools adequately predict flow dynamics and behavior of miniaturized turbopump systems [1-4].

SUMMARY

This disclosure includes embodiments of axial-flow pumps or turbopumps and related methods, such as, for example, miniature pumps or turbopumps. This disclosure also includes embodiments of propulsion systems including embodiments of the present pumps and/or turbopumps.

The present pumps may be suitable for delivering liquid fuel and/or oxidizer to meso-scale propulsion systems, such as may be used in ballistic missiles and/or meso-scale satellite technology. However, the present pumps may also be suitable for use in a variety of other applications, such as, for example, cooling (e.g., electronics), cardio assistive medical devices pediatric ventricular assisting devices (VAD)), microfluidic devices, microsensors, microcooling, microseparation, drug delivery systems, and/or various other applications or implementations.

One example of propulsion systems or devices with which the present pumps may be used includes 1-300 N class rocket engines. Some engines may, for example, be configured as bipropellant engines. Bipropellant propulsion systems may be configured to provide high performance (Specific Impulse, Isp >290 s) and/or versatility (pulsing, restart, variable thrust) characteristics, such as, for example, for orbital maneuvering, divert and attitude control systems of microspacecrafts and/or miniature interceptors. Bipropellant systems based on storable and/or non-carcinogenic propellants may be cost effective due to relatively simple manufacturability and/or relatively low cost ground handling (e.g., when compared to carcinogenic propellants). Current thruster 1-100 N class propulsion engines may use blowdown or regulated systems that rely on pressurized propellant tanks to drive the propellants into the combustion chamber and provide the required combustion pressure. Additional benefits of bipropellant systems may be realized with the present pumps.

The present disclosure includes various embodiments of axial-flow pumps (e.g. miniature axial-flow pumps). For example, a miniature axial flow pump with a nominal diameter of 7 mm, and a nominal length of 17.68 mm was prototyped and tested. The prototyped pump achieved a free delivery discharge rate of 25.08 ml/s while operating at 50,000 rpm. The test results for the prototyped pump showed generally linear throttling at lower shaft speeds (up to 50,000 rpm).

One example of a suitable implementation for certain embodiments of the present pumps includes a 4N Class bipropellant thruster that may for example, be designed to utilize RP-1 and $H_2O_2$ as propellants with a chamber pressure of 4.5 bar, and mixture ratio of 6.59, the specific impulse of 320 s, a volumetric flow rate for RP-1 of 0.20 mL/s, and a volumetric flow rate for $H_2O_2$ of 0.79 ml/s. Such a 4N Class thruster may also have physical characteristics including: a nozzle throat width of 0.38 mm, and expansion ratio of 25, a nozzle have-divergence angle of 15°, a chamber length of 7.5 mm, a convergence section length of 2.5 mm and a divergence section length of 13.5 mm. Assuming these characteristics to hold true, as selected embodiment of the present pumps may have a head requirement of a 4-20 bar pressure rise. Although specific impulse generally increases with pressure rise, the chamber pressure may be constrained by various other parameters of the overall propulsion system. Embodiments of the present pumps, however, may be scaled to different chamber pressures.

Some embodiments of the present axial-flow pumps comprise: a housing having an internal surface defining a channel having an inlet portion and an outlet portion, the channel extending through the housing; an inlet guide having a body and a plurality of axial vanes extending outward from the body, the inlet guide configured to be coupled in fixed relation to the housing inside the channel; a stator spaced apart from the inlet guide, the stator having a stator body and a plurality of curved vanes extending outward from the stator body, the stator configured to be coupled in fixed relation to the housing inside the channel closer to the outlet portion than is the inlet guide, the curved vanes each having a concave upstream surface; and a rotor rotatably disposed between the inlet guide and the stator, the rotor having a rotor body and a plurality of curved vanes extending outward from the rotor body that each have a concave downstream surface, the rotor configured to be coupled to a motor or turbine to rotate the rotor relative to the inlet guide and the stator to pump fluid through the channel in a flow direction from the inlet guide toward the stator; where the pump is configured such that if: the rotor rotates at 10,000 revolutions per minute (rpm), the pump can pump liquid through the channel at a volumetric flowrate of a unit volume per second, where the unit volume is at least two times the channel volume along the length of the inlet guide, the rotor, and the stator.

Some embodiments further comprise a motor or turbine coupled the rotor such that motor or turbine can be actuated to rotate the rotor.

In some embodiments, the pump is configured such that if the rotor rotates at 30,000 rpm, the pump can pump liquid through the channel at a volumetric flowrate of a unit volume per second, where the unit volume is at least twenty times the channel volume along the length of the inlet guide, the rotor, and the stator. In some embodiments, the pump is configured such that if the rotor rotates at 50,000 rpm, the pump can pump liquid through the channel at a volumetric flowrate of a unit volume per second, where the unit volume is at least thirty times the channel volume along the length of the inlet guide, the rotor, and the stator.

In some embodiments, the rotor has at least two longitudinally-spaced cross-sectional shapes at which each rotor vane has a surface that is parallel to a radial axis extending from the rotational axis of the rotor in the respective cross-sectional plane. In some embodiments the stator has at least two longitudinally-spaced cross-sectional shapes at which each stator vane has a surface that is parallel to a radial axis extending from the longitudinal axis of the stator in the respective cross-sectional plane.

In some embodiments, the rotor has a maximum transverse dimension of less than 10 millimeters (mm). In some embodiments, the rotor has a maximum transverse dimension of less than or equal to 7 millimeters (mm).

Some embodiments further comprise a thruster nozzle coupled to the pump such that the rotor can be rotated to pump fluid through the channel and through the thruster nozzle.

In some embodiments, the pump is configured such that if the rotor rotates at 10,000 revolutions per minute (rpm), the pump can generate a pump head of at least 0.12 meters (m) while pumping liquid through the channel at a volumetric flowrate of 1.2 milliliters per second (mL/s).

In some embodiments, the inlet guide includes a domed upstream end. In some embodiments, the stator includes a domed downstream end.

Some embodiments of the present axial-flow pumps comprise: a housing having an internal surface defining a channel having an inlet portion and an outlet portion, the channel extending through the housing; an inlet guide having a body and a plurality of axial vanes extending outward from the body, the inlet guide configured to be coupled in fixed relation to the housing inside the channel; a stator spaced apart from the inlet guide, the stator having a stator body and a plurality of curved vanes extending outward from the stator body, the stator configured to be coupled in fixed relation to the housing inside the channel closer to the outlet portion than is the inlet guide, the curved vanes each having a concave upstream surface; and a rotor rotatably disposed between the inlet guide and the stator, the rotor having a rotor body and a plurality of curved vanes extending outward from the rotor body that each have a concave downstream surface, the rotor configured to be coupled to a motor or turbine to rotate the rotor relative to the inlet guide and the stator to pump fluid through the channel in a flow direction from the inlet guide toward the stator; where the pump is configured such that: the maximum transverse dimension of any of the rotor is less than or equal to 8 millimeters (mm); and if the rotor rotates at 10,000 revolutions per minute (rpm), the pump can pump liquid through the channel at a volumetric flowrate of at least 2 milliliters per second (mL/s).

Some embodiments further comprise a motor or turbine coupled the rotor such that the motor or turbine can be actuated to rotate the rotor.

In some embodiments, the pump is configured such that if the rotor rotates at 30,000 rpm, the pump can pump liquid through the channel at a volumetric flowrate of at least 15 mL/s. In some embodiments, the pump is configured such that if the rotor rotates at 50,000 rpm, the pump can pump liquid through the channel at a volumetric flowrate of at least 25 mL/s. In some embodiments, In some embodiments, the rotor has at least two longitudinally-spaced cross-sectional shapes at which each rotor vane has a surface that is parallel to a radial axis extending from the rotational axis of the rotor in the respective cross-sectional plane. In some embodiments, the stator has at least two longitudinally-spaced cross-sectional shapes at which each stator vane has a surface that is parallel to a radial axis extending from the longitudinal axis of the stator in the respective cross-sectional plane.

Some embodiments further comprise a thruster nozzle coupled to the pump such that the rotor can be rotated to pump fluid through the channel and through the flimsier nozzle.

In some embodiments, the pump is configured such that if the rotor rotates at 10,000 revolutions per minute (rpm), the pump can generate a pump head of at least 0.12 meters (m) while pumping liquid through the channel at a volumetric flowrate of 1.2 milliliters per second (mL/s).

In some embodiments the inlet guide includes a domed upstream end. In some embodiments, the stator includes a domed downstream end.

Any embodiment of any of the present devices and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

FIG. 2.0 depicts results of computational fluid dynamic modeling of 2× inlet guide vanes at an initial velocity of 2 meters per second (2 m/s).

DESCRIPTION OF ILLUSTRATIVE EMBODIMENTS

Figure 1A:
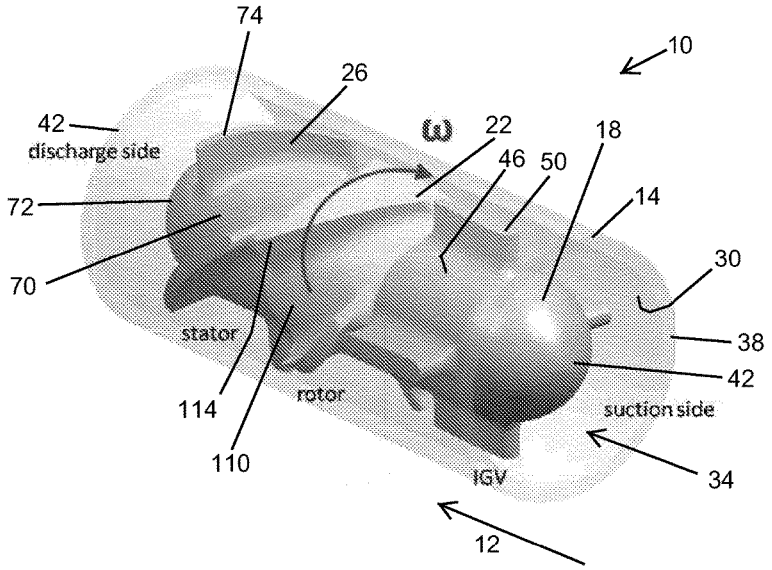
FIGS. 1A and 1B depict perspective assembled and exploded views, respectively, of one embodiment of the present axial-flow pumps.
Figure 1B:
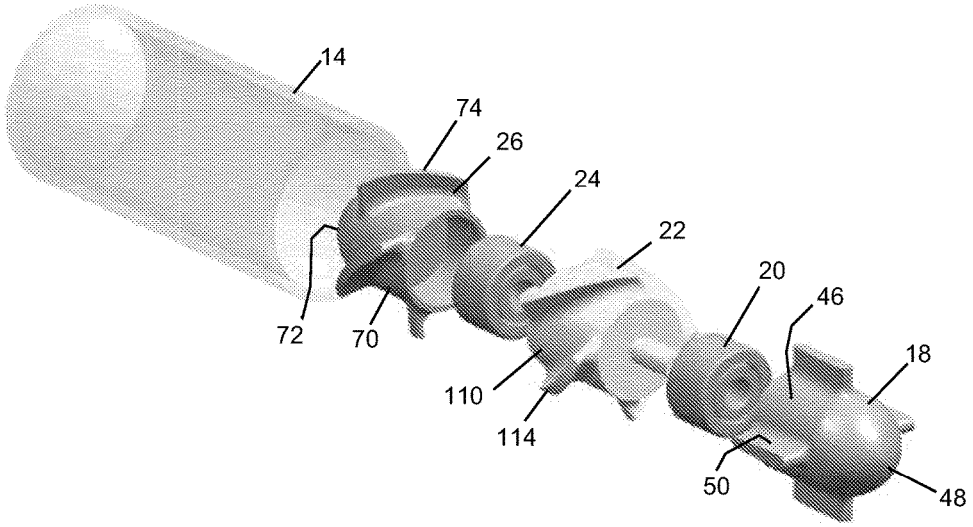

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Further, a device, system, or structure that is configured in a certain way is configured in at least that way, but it can also be configured in other ways than those specifically described.

Referring now to the drawings, and more particularly to FIGS. 1-4B, shown there and designated by the reference 10 is one embodiment of the present axial-flow house that is configured to pumps fluid through the pump in a flow direction 12. As shown, pump 10 comprises a housing 14, an inlet guide 18, a rotor or impeller 22, and a stator 26. Inlet guide 18 is configured to help guide and straighten the flow before going into the rotor stage or portion of the pump. Rotor 22 is configured to be rotated to increase the flow velocity to the desired level. Stator 26 is configured to reduce flow velocity and increase fluid pressure. In the embodiment shown, inlet guide 18 and stator 26 are both configured to be coupled in fixed relation to housing 14 (such that inlet guide 18 and stator 26 are stationary relative to housing 14 during operation of pump 10).

In the embodiment shown, housing 14 has an internal surface 30 to define a channel 34. Channel 34 includes an inlet portion 38 (e.g., region or end) and an outlet portion 42 (e.g., region or end), and channel 34 extends through housing 14 (e.g., through at least a portion of a length or other dimension of housing 14). In the embodiment shown, housing 14 is configured such that a single piece of the housing defines or includes entirety of internal surface 30 that defines channel 34. In other embodiments, housing 14 may include multiple pieces or portions, some of which each includes or defines a portion of surface 30. In the embodiment shown, channel 34 has a substantially (e.g. including perfectly) circular cross-sectional shape. In other embodiments, channel 34 may be configured to have any suitable cross-sectional shape, such as, for example, an oval or fanciful shape.

In the embodiment shown, inlet guide 18 has a body 46 with a domed inlet end 48 and a plurality of axial (extending substantially parallel to the longitudinal axis of inlet guide 18) vanes 50 extending outward (e.g., radially outward) from body 46. As shown, inlet guide 18 is configured to be coupled in fixed relation to housing 14 inside channel 34 (e.g., by way of pins, adhesive, screws, rivets, bolts, and/or the like). In the embodiment shown, body 46 has a substantially circular cross-sectional shape. In other embodiments, body 46 can have any suitable cross-sectional shape, such as, for example, a rectangle, triangle, of the like (e.g., with a vane extending outward from each vertex). Inlet guide 18 is shown with four vanes 50 spaced at equiangular intervals around the perimeter of body 46. In other embodiments, inlet guide 18 can comprise any suitable number of vanes (e.g., space at equiangular intervals around the perimeter of body 46), such as, for example, three, five, six, or more.

Figure 2A:
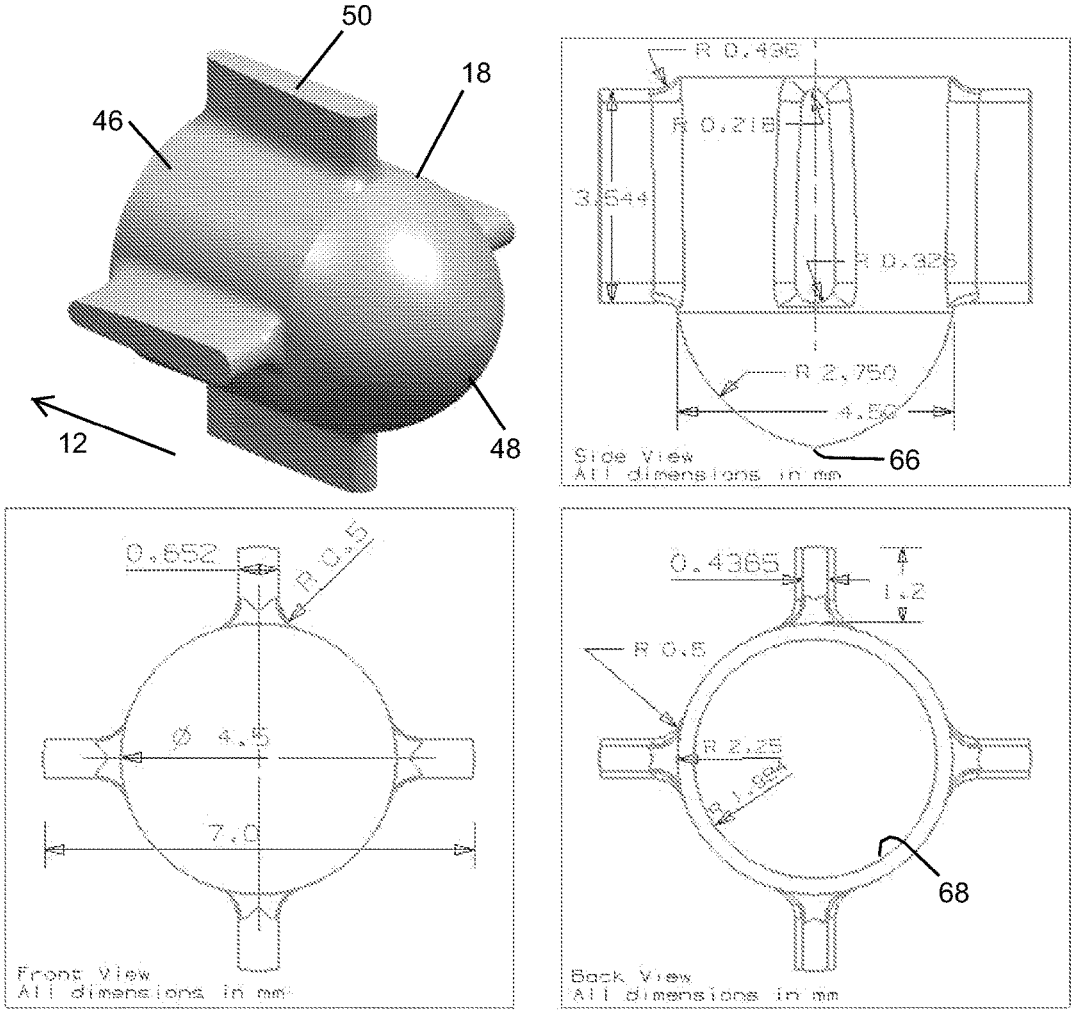
FIG. 2A depicts various views of an inlet guide of the pump of FIGS. 1A-1B.
Figure 2B:
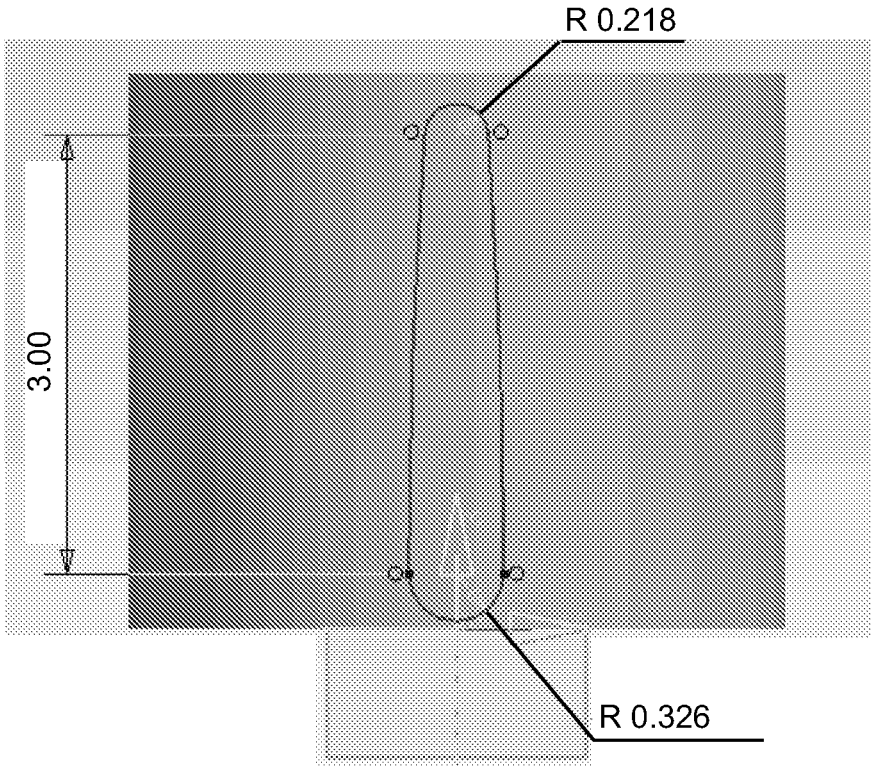
FIG. 2B depicts a cutting path for forming each vane of the inlet guide of FIG. 2A.

FIG. 2A includes perspective, side, front, and back views of one embodiment of inlet guide 18. FIG. 2B depicts a plan view of the two-dimensional tool cutting path used to mill each of vanes 50. The dimensions in FIG. 2A are shown in millimeters (mm), are merely examples of dimensions and proportions that are suitable for certain mesoscale implementations of the pump, and are not intended to be limiting. For example, in other embodiments, various dimensions may be scaled up or scaled-down in accordance with specific mesoscale implementations of the pump. In the embodiment shown, each vane 50 includes a curved leading edge 54, a curved trailing edge 58, and two lateral surfaces 62 extending between leading edge 54 and trailing edge 58. In other embodiments, leading edge 54 and/or trailing edge 58 may be formed with alternate shapes, such as, for example, arcuate surfaces that form a vertex at the respective end. Domed end 48 is defined by a surface having a radius that is larger than the radius of body 46, such that domed end 48 includes a vertex 66 at its center. In other embodiments, domed end 48 may be hemispherical. As shown in the back view of FIG. 2A, inlet guide 18 may also include an enlarged cavity 68 configured to receive a bearing 20 to support smooth rotation of rotor 22 relative to inlet guide 18, as described and depicted for the constructed prototype discussed below.

In the embodiment shown, stator 26 is spaced apart from inlet guide 18. As shown, stator 26 has a stator body 70, a domed end 72 and a plurality of curved vanes 74 extending outward from stator body 70. Stator 26 is configured to be coupled in fixed relation to housing 14 inside channel 34. However, stator 26 is configured to be coupled to housing 14 closer to outlet portion 42 than is inlet guide 18 (inlet guide 18 is configured to be further from outlet portion 42 than is stator 26). Curved vanes 74 each have a concave upstream surface 78 (surface that generally faces inlet portion 38) in the embodiment shown and curved vanes 74 each have a convex downstream surface 82 (surface that generally faces outlet portion 42). In the embodiment shown, stator body 70 has a substantially circular cross-sectional shape. In other embodiments, stator body 70 can have any suitable cross-sectional shape, such as, for example, a rectangle, triangle, or the like (e.g., with a vane extending outward from each vertice). Stator 26 is shown with four vanes 74 spaced at equiangular intervals around the perimeter of stator body 70. In other embodiments, stator 26 can comprise any suitable number of vanes 74 (e.g., space at equiangular intervals around the perimeter of body 70), such as, for example, three, five, six, or more.

Figure 3A:
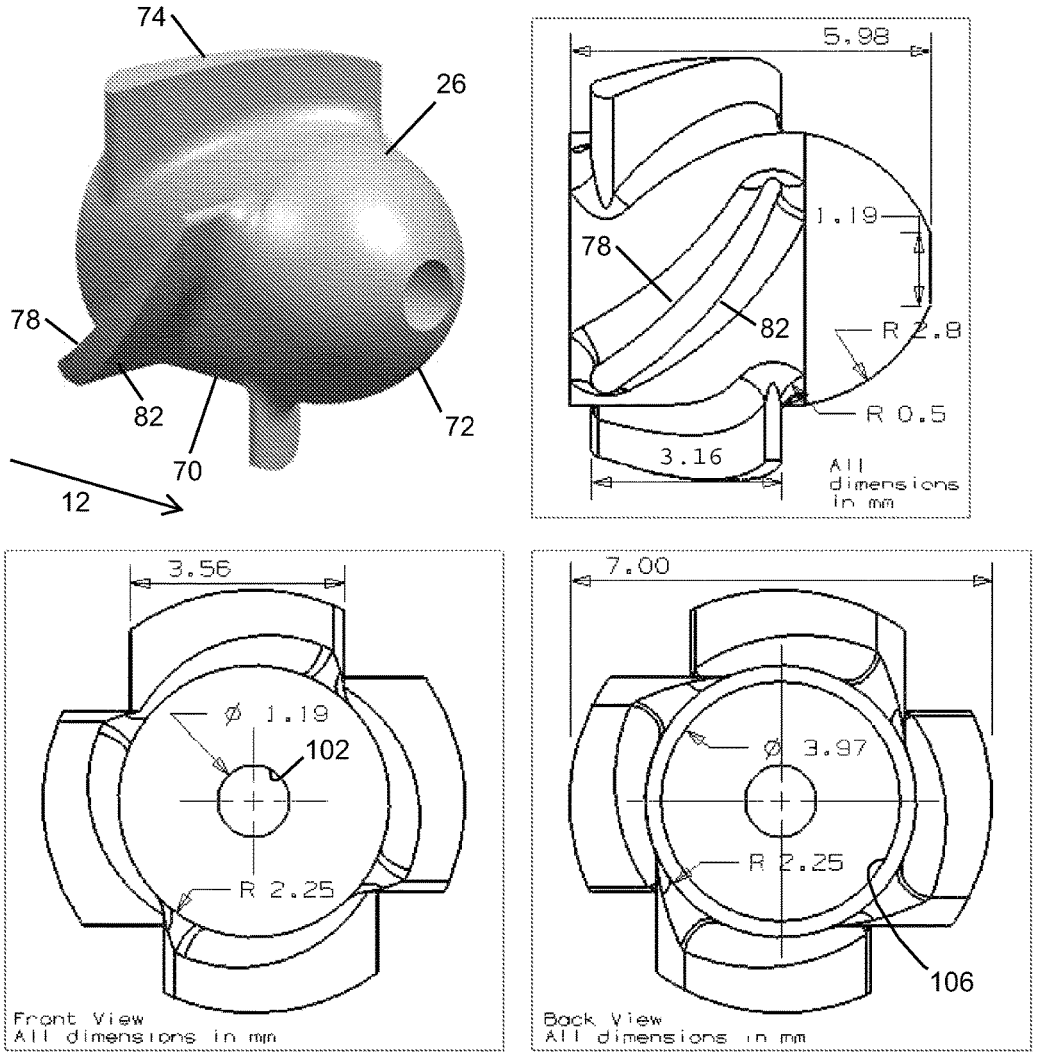
FIG. 3A depicts various views of a stator of the pump of FIGS. 1A-1B.
Figure 3B:
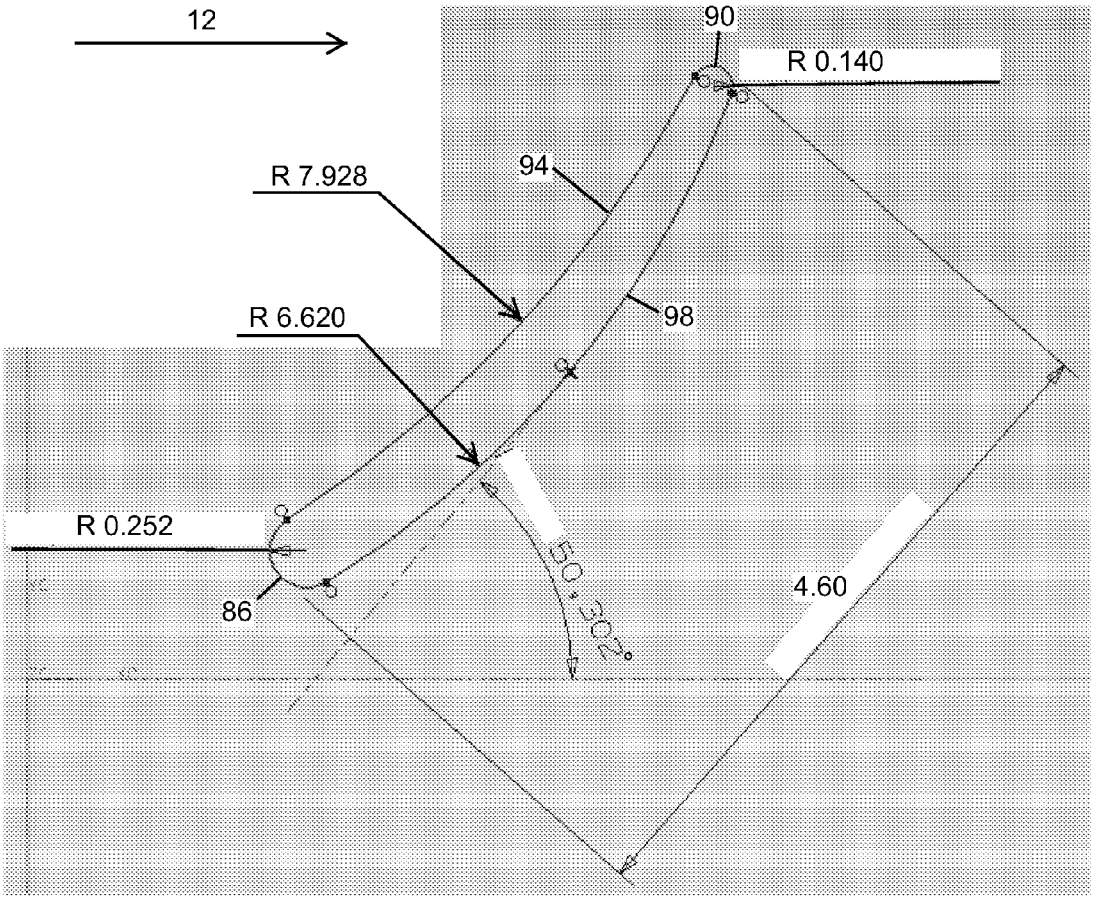
FIG. 3B depicts a cutting path for forming each vane of the stator of FIG. 3A.

FIG. 3A includes perspective, side, front, and back views of one embodiment of stator 26. FIG. 3B depicts a plan view of the two-dimensional tool cutting path used to mill each of vanes 74. The dimensions in FIG. 3A are shown in millimeters (mm), are merely examples of dimensions and proportions that are suitable for certain mesoscale implementations of the pump, and are not intended to be limiting. For example, in other embodiments, the various dimensions may be scaled up or scaled down in accordance with specific mesoscale implementations of the pump. In the embodiment shown, the cutting path for vane 74 (and thereby vane 74) includes a curved leading edge 86, a curved trailing edge 90, an upstream surface 94, and a downstream surface 98.

Figure 6A:
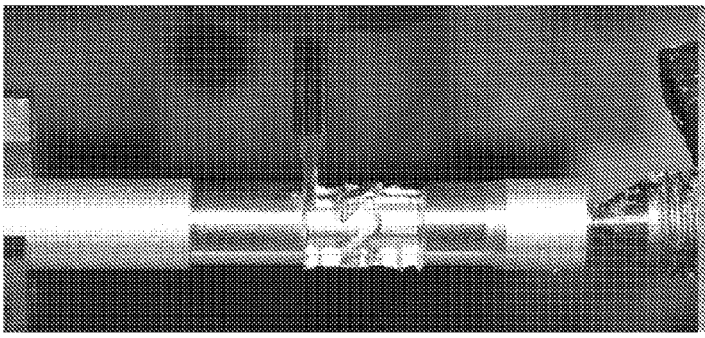
FIGS. 6A-6B depict a prototyped rotor of FIG. 4A.

As is illustrated in FIG. 6A, the two-dimensional cutting path of FIG. 3B (and that of FIG. 4B) can define the cutting path of a tool bit, such as in a CNC mill, such that rotation of a (e.g., cylindrical) workpiece can trace the lateral component of the cutting path, and longitudinal linear motion of the tool bit can trace the longitudinal component of the cutting path; thereby generating the three-dimensional upstream surface 78 from a two-dimensional upstream surface 94, and generating the three-dimensional downstream surface 82 from the two-dimensional downstream surface 98. In this way, the longitudinal axis of the cutting tool is always parallel to lease one radial axis of the workpiece (and the resulting longitudinal axis of the stator 26). As a result, in embodiment shown, stator 26 has at least two longitudinally-spaced cross-sectional shapes (perpendicular to the longitudinal axis of stator 26) at which each stator vane 74 has (a straight line along) a surface (e.g., at least a portion of upstream surface 78 and/or at least a portion of downstream surface 82) that is parallel to a radial axis extending from the longitudinal axis of the stator in the respective cross-sectional plane. In the embodiment shown, the entire perimeter of (e.g. an outer portion, outside the illustrated fillet at the base of) each stator vane 74 has (a straight line along) a surface that is parallel to a radial axis extending from the longitudinal axis of the stator in the cross-sectional plane of the of the parallel straight-line.

In the embodiment shown, each of upstream and downstream surfaces 78 and 82 is curved (corresponding to arcuate surfaces 94 and 98). In other embodiments, leading edge 86 and/or trailing edge 90 may be formed with alternate shapes, such as, for example, arcuate surfaces that form a vertex at the respective end. Domed end 72 is defined by a surface having a radius that is larger than the radius of body 70, such that domed end 72 would include a vertex in the absence of hole 102 that, in the embodiment shown, extends through the center of domed end 72 to permit a shaft to be coupled to rotor 22, as described in more detail below for the prototype motor. As shown in the back view of FIG. 3A, stator 26 may also include an enlarged cavity 106 configured to receive a bearing to support smooth rotation of rotor 22 relative to stator 26, as described and depicted for the constructed prototype discussed below.

In the embodiment shown, rotor 22 is configured to be (and is shown) rotatably disposed between inlet guide 18 and stator 26. In the embodiment shown, rotor 22 includes a rotor or body 110 and a plurality of curved vanes 114 extending outward from rotor body 110. Curved vanes 114 each have a concave downstream surface 118. In the embodiment shown, curved vanes 114 each have a convex upstream surface 122. Rotor 22 is configured to be coupled to a motor or other source of rotation to rotate rotor 22 relative to inlet guide 18 and stator 26 to pump fluid through channel 34 in flow direction 12. In the embodiment shown, rotor 22 is configured to be coupled to a motor by way of a shaft coupled in fixed relation to rotor 22 (e.g., via hole 126) and extending through at least one of one of inlet guide 18 and stator 26 (e.g. through hole 102 of stator 26). In the embodiment shown, rotor body 110 has a substantially circular cross-sectional shape. In other embodiments, rotor body 110 can have any suitable cross-sectional shape, such as, for example, a rectangle, triangle, or the like (e.g., with a vane extending outward from each vertex). Rotor 22 is shown with four vanes 114 spaced at equiangular intervals around the perimeter of rotor body 110. In other embodiments, rotor 22 can comprise any suitable number of vanes 114 (e.g., space at equiangular intervals around the perimeter of body 114), such as, for example, three, five, six, or more.

Figure 4A:
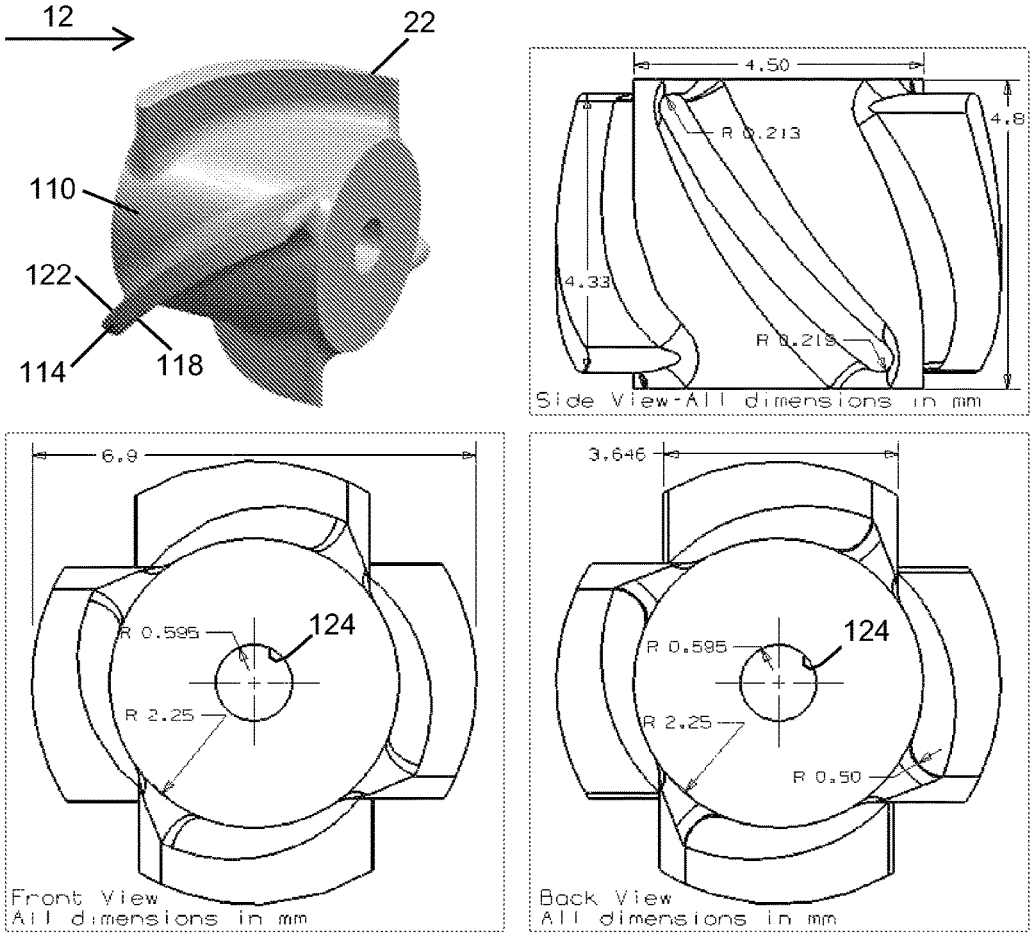
FIG. 4A depicts various views of a rotor of the pump of FIGS. 1A-1B.
Figure 4B:
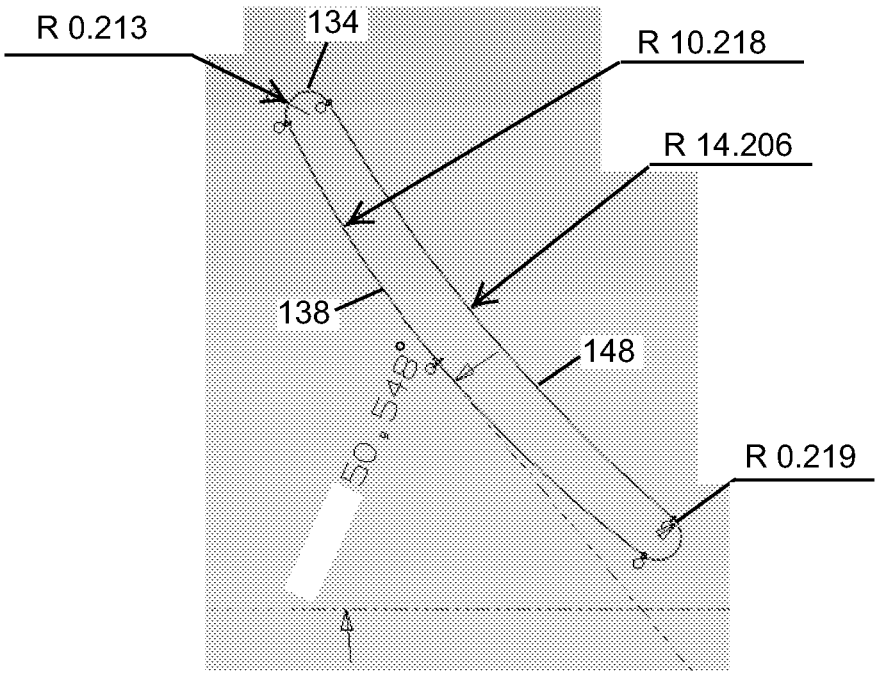
FIG. 4B depicts the cutting path for forming each vane of the rotor of FIG. 4A.

FIG. 4A includes perspective, side, front, and back views of one embodiment of rotor 22. FIG. 4B depicts a plan view of the two-dimensional tool cutting path used to mill each of vanes 114. The dimensions in FIG. 4A are shown in millimeters (mm), are merely examples of dimensions and proportions that are suitable for certain mesoscale implementations of the pump, and are not intended to be limiting. For example, in other embodiments, the various dimensions may be scaled up or scaled down in accordance with specific mesoscale implementations of the pump. In the embodiment shown, the cutting path for vane 114 includes a curved (e.g., arcuate) leading edge 130, a curved (e.g., arcuate) trailing edge 134, an upstream surface 138, and a downstream surface 142.

As is illustrated in FIG. 6A, the two-dimensional cutting path of FIG. 4B can define the cutting path of a tool bit, such as in a CNC mill, such that rotation of a (e.g., cylindrical) workpiece can trace the lateral component of the cutting path, and longitudinal linear motion of the tool bit can trace the longitudinal component of the cutting path, thereby generating the three-dimensional upstream surface 122 from a two-dimensional upstream surface 138, and generating the three-dimensional downstream surface 118 from the two-dimensional downstream surface 142. In this way, the longitudinal axis of the cutting tool is always parallel to at least one radial axis of the workpiece (and the resulting longitudinal axis of the rotor 22). As a result, in the embodiment shown, rotor 22 has at least two longitudinally-spaced cross-sectional shapes (perpendicular to the longitudinal and rotational axis of rotor 22) at which each rotor vane 114 has (a straight line along) a surface (e.g., at least a portion of upstream surface 122 and/or at least a portion of downstream surface 118) that is parallel to a radial axis extending from the rotational axis of the rotor in the respective cross-sectional plane. In the embodiment shown, the entire perimeter of (e.g. an outer portion, outside the illustrated fillet at the base of) each rotor vane 114 has (a straight line along) a surface that is parallel to a radial axis extending from the rotational axis of the rotor in the cross-sectional plane of the parallel straight line.

In the embodiment shown, each of upstream and downstream surfaces 122 and 118 is curved (corresponding to arcuate surfaces 142 and 138). In other embodiments, leading edge 130 and/or trailing edge 134 may be formed with alternate shapes, such as, for example, arcuate surfaces that form a vertex at the respective end. As shown in the back view of FIG. 4A, rotor 22 may include a hole 124 extending through at least a portion of (up to all of) a rotor 22 (e.g., such that the center of hole 124 is co-linear with the longitudinal rotational axis of the rotor) such that the shaft of a motor or turbine can extend into hole 124 to be coupled to rotor 22.

Figure 10:
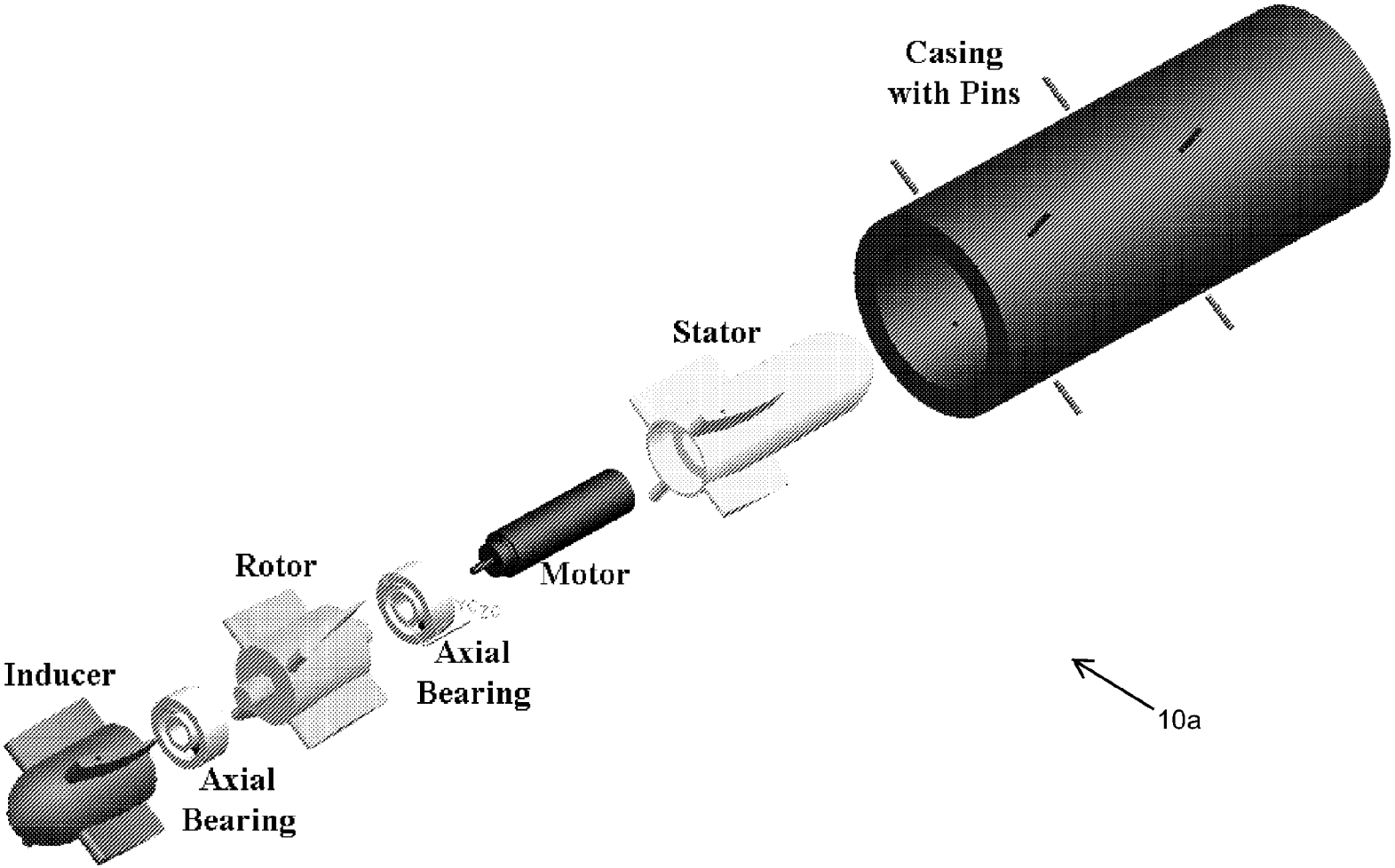
FIG. 10 depicts an exploded perspective view of another embodiment of the present axial-flow micro pumps.

Some embodiments further comprise a motor or turbine coupled to rotor 22 such that the motor or turbine can be actuated to rotate rotor (e.g., such that fluid is pumped through channel 34). For example, FIG. 10 depicts alternate embodiment 10*a* that is substantially similar to pump 10, but in which the stator has an elongated body having a cavity configured to receive and house a motor that is coupled to the rotor.

In some embodiments, pump 10 is configured such that if: rotor 10 rotates at 10,000 revolutions per minute (rpm), the pump can pump liquid through 34 channel at a volumetric flowrate of a unit volume per second, where the unit volume is at least two (e.g., 2.1, 2.2, 2.3, 2.4, 2.5, 2.6, 2.7, 2.8, 2.9, 3.0, or more) times the channel volume along the length of inlet guide 18, rotor 22, and stator 26 (the length extending between the outermost points of inlet guide 18 and stator 26, respectively, along the rotational axis of rotor 22). For example, in the embodiment shown, if the channel diameter is 7 mm, the channel volume along the length (about 17.68 mm) of inlet guide 18, rotor 22, and stator 26, is about 680 mm.sup.3 or 0.68 mL (without excluding the volume occupied by inlet guide 18, rotor 22, and stator 26). As such, a volumetric flowrate of 2 mL/s results in a unit volume of 2 mL, which is at least 2 times (about 2.9 times) the channel volume along the length of inlet guide 18, rotor 22, and stator 26.

In some embodiments, the pump is configured such that if the rotor rotates at 30,000 rpm, the pump can pump liquid through the channel at a volumetric flowrate of a unit volume per second, where the unit volume is at least twenty (e.g., 21, 22, 23, 24, 25, or more) times the channel volume along the length of the inlet guide, the rotor, and the stator. For example, in the embodiment shown, the pump is configured such that if the rotor rotates at 30,000 rpm, the pump can pump liquid through the channel at a volumetric flowrate of at least 15 mL/s, which is about 22 times the channel volume along the length of inlet guide 18, rotor 22, and stator 26.

In some embodiments, the pump is configured such that if the rotor rotates at 50,000 rpm, the pump can pump liquid through the channel at a volumetric flowrate of a unit volume per second, where the unit volume is at least thirty (e.g., 30, 31, 32, 33, 34, 35, 36, 37, 38, 39, 40, or more) times the channel volume along the length of the inlet guide, the rotor, and the stator. For example, in the embodiment shown, the pump is configured such that if the rotor rotates at 50,000 rpm, the pump can pump liquid through the channel at a volumetric flowrate of at least 25 mL/s, which is about 37 times the channel volume along the length of inlet guide 18, rotor 22, and stator 26.

In some embodiments, pump 10 is configured such that channel 34 and/or rotor 22 has a maximum transverse dimension (e.g., diameter or vane diameter) of less than 10 mm (e.g., equal to, less than, greater than, and/or between, any of: 10, 9.5, 9, 8.5, 8, 7.5, 7, 6.5, 6, 5.5, and/or 5). For example, in the embodiment shown, each of the inlet guide 18, rotor 22, and stator 26 has a body diameter of 3.5 mm; inlet guide 18 and stator 26 each have vane diameter (diameter of a circle circumscribing the outermost portions of all vanes) of 7 mm, and rotor 22 has a vane diameter of 6.9 mm (e.g., reduced to provide clearance between the outermost portions of the rotor vanes and internal surface 30 of housing 14). As such, in the embodiment shown, the pump is configured such that: the maximum transverse dimension of the rotor is less than or equal to 8 millimeters (mm); and if the rotor rotates at 10,000 revolutions per minute (rpm), the pump can pump liquid through the channel at a volumetric flowrate of at least 2 mL/s.

In some embodiments, the pump is coupled to a thruster nozzle (not shown, but such as, for example, a 4N Class thruster nozzle, as described above), such that rotor 22 can be rotated to pump fluid through channel 34 and through the thruster nozzle.

1. Prototype Manufacturing

The embodiment shown in FIGS. 1A-4B was manufactured in a prototype configuration for testing. Unigraphics NX-4 software was used to develop a 3-D model of each pump component: inlet guide 18, rotor 22, and stator 26. FIG. 1A depicts the pump modeled with the CAD software. The Unigraphics program was also used to generate the G-code needed for manufacturing pump parts with a CNC mill and a CNC lathe. Initial prototypes were made using acrylic, and testable pump components were manufactured from Al 6061 aluminum alloy. Aluminum alloy is suitable for certain embodiments of the present pumps because of its ease of machining and favorable weight characteristics. For the prototype, bearings 20 and 24 were double-shielded, ABEC-5, stainless steel ball bearings. Another material that is suitable for certain embodiments of the present pumps is Ti—Al6V4 titanium alloy, which while more difficult to machine, can have high strength to weight properties.

For each of the parts, the milling tool path, spindle speed, feed rate, and cut depth were selected to provide tight dimensional tolerances and high-quality surface finish. More particularly the machining operations were simulated with the Unigraphics program to be performed on a blank cylindrical stock having a diameter of 7.1 mm. The mill tool bit used to machine the prototype parts was a 1.1938 mm ball end mill. Once all the parameters and machining operations were set on the Unigraphics program, the program was utilized to simulate a tool path, which was a three-pass process that plunged a depth of 1.5 mm per pass. The plunged depth was chosen to avoid a deep plunge and possible fracture of the mill. The necessary code was generated to run a tabletop CNC milling machine.

Prior to machining (milling) the prototype inlet vane 18, a blank with dimensions matching those of the simulation was fabricated. More particularly, a piece of 7.94 mm diameter aluminum round stock was turned down in a lathe to a diameter of 7.1 mm, and center drilled on both ends for use on a live center tail stock. The length of the reduced diameter was approximately 25.4 mm to ensure an adequate length of 7.1 mm diameter material for machining the inlet guide. The stock was then set up on the mill using a rotary table and a dead center tail stock. The milling software was used for all jogging and CNC operations. Prior to milling, the clearance of the spindle head was checked for interference with the rotary table, and the y-axis was zeroed utilizing a Starrett edge finder (which utilizes a cam that when contacted with the work piece will "kick" off-center and indicate the location of the edge). Once the y-axis zero was found, the mill was jogged to the center line of the blank. The x-axis zero was chosen arbitrarily on the blank as this dimension was not crucial for proper machining.

The z-axis was zeroed next. With the 1.1938 mm ball end mill secured in the spindle collet, the z-axis was lowered to within a few millimeters of the blank stock. A video microscope was then used to find the exact zero. The microscope used was a JAI CV-S3:200N which has a resolution of 768×494 pixels with a 3× magnification. The microscope was connected to a television monitor through a BNC-to-RCA cable connection, which provided about another 25× magnification (total 75× magnification). The use of the monitor permitted real time video of the item placed under the microscope. The microscope was placed on the bench and focused on the surface of the blank stock perpendicular to the z-axis. The majority of the machining of the pump components was done using a 1.1938 mm four flute, ball end mill. Since the flutes on this ball end mill were very small, it was difficult with the naked eye to visually inspect chip formation when the spindle was rotated manually. Even without a z depth gauge, the microscope connected to a television monitor provided a high-enough zoom to step the z-axis at intervals of 0.00254 mm and enable the inspection of the chip formation.

With the axes zeroed, the G-code and CNC software were used to initiate the machining process. The initial feed rate was 25 mm/min, which increased to 80 mm/min after the first plunge. Throughout the machining process a spindle speed of 6500 rpm was used. The piece being machined was divided into three different passes, each with a different cut depth from the initial z-axis zero. Each pass plunged the mill 0.5 mm, which removed the correct amount of material without mill fracture. Compressed air was used to cool the first two passes and non-chlorinated brake parts cleaner was used to cool the finishing pass. The brake cleaner helped to cool the piece and aided in removing swarf from the flutes of the ball end mill. The use of the brake parts cleaner also improved the surface finish of the pump component during the CNC machining process over the use of compressed air. FIG. 6A illustrates the mill in use.

After completion of the first vane (50) of inlet guide 18, the rotary table was automatically turned 90 degrees, and the second vane was machined using the same plunging and cooling procedures. The third and fourth sides were machined similarly. The inlet guide and stator were both designed with a smooth-converging nose and tail end, respectively that help condition the flow through the pump. The nose and tail ends of the inlet guide and stator were machined using the proper G-code developed using the UGS software. FIG. 4A shows the finished inlet guide 18. Tool marks were created (e.g., on the nose of the inlet guide) due to the limiting resolutions of the stepper motors in the CNC milling machine. Tool marks were removed by polishing with a fine grit abrasive and selective electropolishing of the vanes. The inlet guide (18) was separated from the stock piece using a parting tool on a tabletop lathe. The part was measured to specifications, and cut front the stock.

Because such small parts are not easily held in a clamp vise or chuck, a new method of fixturing was developed to secure the inlet guide (and other small parts, such as for example, stator 26) for final machining. Embodiments of the present methods comprise defining a hole or receptacle in a dummy work piece (e.g., a dummy work piece configured to be received in a clamp, CNC milling machine, or CNC lathe); disposing the target workpiece (e.g., inlet guide 18) in the hole or receptacle; causing or permitting a liquid material (e.g., molten material) to flow into the hole or receptacle between the target workpiece and the dummy workpiece; and permitting the liquid material to cool and/or otherwise harden to couple the target workpiece in fixed relation to the dummy workpiece. In seine embodiments, the dummy workpiece is configured such that when coupled to the target workpiece, the combination of the target and dummy workpieces can be received in a CNC milling machine and/or a CNC lathe as if the combination of the target and dummy workpieces were a single workpiece, and such that the CNC milling machine and/or CNC lathe can work on the target workpiece. In some embodiments, the method further comprises machining, drilling, and/or otherwise modifying the target workpiece; and/or molten or otherwise liquefying the material 208 removing material 208 from hole 204; removing the target workpiece from the dummy workpiece (e.g., from hole 204); and/or any combination of the foregoing, steps and/or components.

Figure 5A:
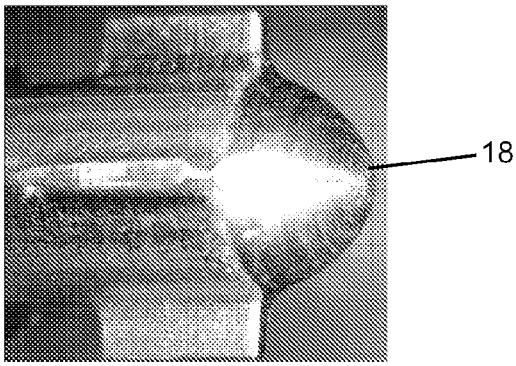
FIGS. 5A-5D depict various views of a prototyped inlet guide of FIG. 2A.
Figure 5B:
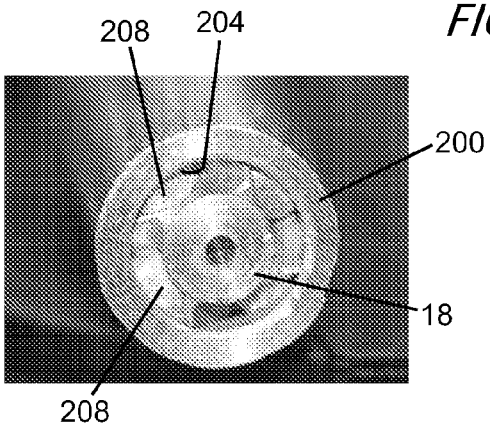
Figure 5C:
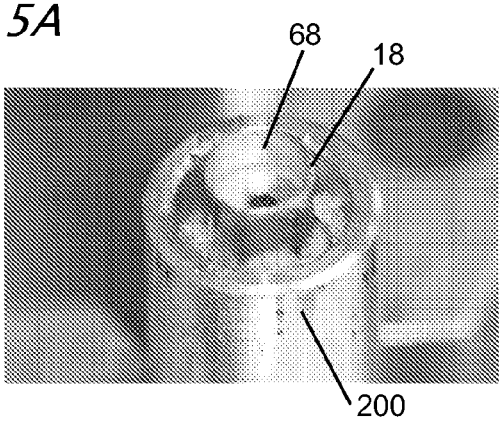
Figure 5D:
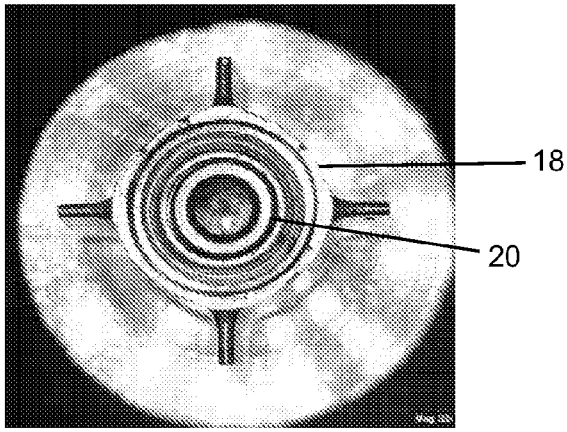

In one example shown in FIGS. 5B-5C, a dummy workpiece (jig) 200 was created by boring a 7 mm hole 204 in one end of a piece of cylindrical aluminum stock (e.g., aluminum stock) having a diameter of 7.94 mm such that the hole could receive the inlet vane as shown. With the inlet vane in the jig, the hole was filled with a molten bismuth alloy 208 to hold the component in place (FIG. 4B). A bearing housing (hole 68) was then machined to receive ball bearings. The bearing housing was machined using the mill and the rotary table. The jig was placed in a 4-jaw chuck and secured on the rotary table. The mill was then jogged to find the exact center of the jig using an edge finder and the dimensions of the jig. The bearing housing was then machined using a 2.38 mm flat end mill by offsetting the spindle approximately 0.788 mm from center. This ensured that the housing would meet press fitment specifications. The spindle was set at 5000 rpm and stepped down 0.1 mm at a time. The rotary table was then manually rotated 360 deg. until the specified diameter was met. Every step of the z-axis and revolution of the rotary table created a recessed area for the bearing assembly. This step was repeated until the exact depth was achieved for the bearing assembly to fit. The bearings used were off-the-shelf ABEC-5, double-shielded ball bearings of 2.39 mm width, 3.96 mm outside diameter, 1.19 mm bore diameter, and maximum speed rating of 120,000 rpm. FIG. 4D shows the bearing assembly installed in the inlet guide. Hole 68 was sized to receive bearing 20 with a press fit of 0.01 mm (manufacturer's recommendation for a high speed use). FIG. 4C shows the bearing housing milled from the inlet vane in the aluminum jig. Once the bearing housing was milled, the bismuth alloy was simply inched away using a propane torch and the inlet guide were removed from the jig. The bearing was then placed in the housing as shown in FIG. 4D.

FIG. 3A shows a three-dimensional CAD model of stator 26. For the prototyped stator, a 7.1 mm aluminum blank was machined and set up in the mill, as described above. Each axis was zeroed and G-codes were developed for the stator vanes. The domed end (72) was then machined utilizing another G-code generated from the CAD simulation. Once the domed end was machined, the stock was placed on the lathe to drill a hole 102 through the center of the stator for the drive shaft. The hole drilled was 1.19 mm, which matches the diameter of the bearing bore diameter for ease of rotation. The stator vane was then cut from the blank stock and placed into the same jig 200 used for the inlet vane, to machine a similar bearing housing (hole 106) for the stator. The machining operations for hole 106 were similar to those for hole 68 of the inlet vane. FIGS. 8B-8C show the completed stator vane.

Figure 6B:
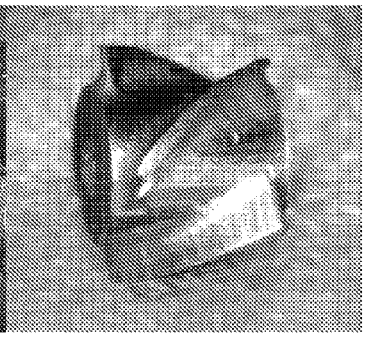
Figure 7A:
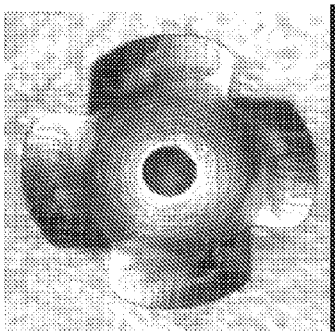
FIGS. 7A-7C depict various views of a prototyped stator of FIG. 4A.
Figure 7B:
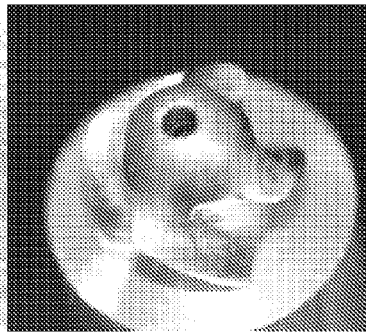
Figure 7C:
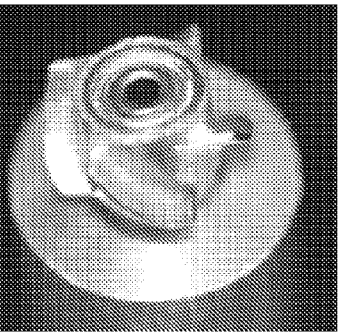

Rotor 22 was next machined. The rotor was fabricated using similar operations as those used for the inlet guide and the stator. The rotor was machined with a 1.19 mm through hole 124 to accommodate a drive shaft. Hole 124 was drilled using the lathe and drilling through the center of the stock with the rotor machined on it. Once the hole was drilled, the final operation for the rotor was cutting the rotor off of the blank stock to the specified dimension. This was done using the parting tool and lathe. Once the part was cut, the rotor was assembled with the inlet vane, stator vane, and bearings for inspection. FIG. 6B shows the fabricated rotor.

Figure 8:
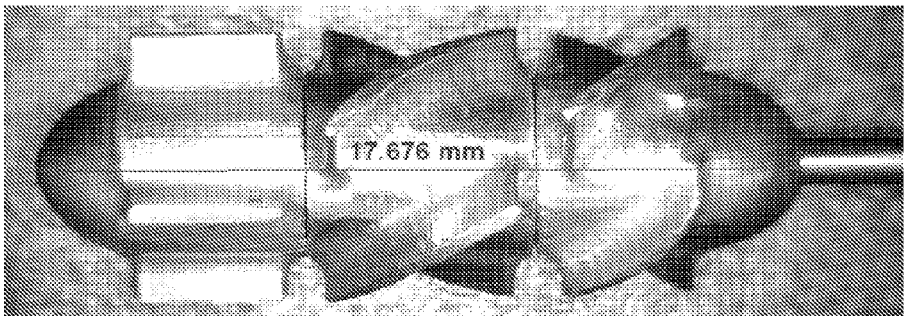
FIG. 8 depicts the assembled prototyped inlet guide, rotor, and stator.

A high magnification digital microscope with measurement software was used to inspect the fabrication accuracy of the pump components. The tolerances and dimensions were then cross-referenced with the CAD design to determine the accuracy of the fabrication processes. The parts were electropolished using a cryogenically cooled nitric acid and ethanol chemical bath to improve surface finish. FIG. 8 shows the pump assembly with drive shaft 212.

2. Prototype Testing

The prototyped pump was then tested experimentally to determine performance characteristics. A pump test apparatus was assembled to measure the performance curve of the prototyped miniature pump. As also described in more detail below, at 50,000 rpm the pump achieved a 25.08 ml/s discharge rate for the free delivery condition, which is believed to confirm the technical feasibility of the present miniature pumps for micropropulsion applications.

The experimental setup included the assembled miniature pump prototype, a vibration-free high speed motor, flow control valves, two fluid reservoirs, tubing, pressure transducers, turbine flow meters, and data acquisition systems. FIGS. 10A-10B show a portion of the test set up that includes the complete pump assembly 10 inside a polished acrylic housing 14*a* that defines surface 30 and channel 34. The experimental setup was designed to incorporate the use of quick fittings whenever possible, to allow for a quick change of components in the event of component failure, setup reconfiguration, or the need to use an alternate measurement device. All components were fixed to a 0.375 in thick aluminum optical bench plate to minimize vibrations and any unwanted motion of components. For preliminary experiments distilled de-ionized water was used as the pump liquid (as a surrogate fir propellant).

Two Plexiglas containers of interior dimensions of H=15.2 cm, L=11.4 cm, and W=10.2 cm served as supply and discharge-recovery reservoirs. A clear polyethylene tube connecting the two reservoirs was used to maintain fluid levels and replenish the supply reservoir. The volume of each reservoir was about 1.78 liters, and the inlet to the supply reservoir and the outlet of the discharge reservoir were located at a depth of 11.4 cm from the top of the respective reservoir. Fluid was filled to within 2.54 cm of the top of each reservoir and the pressure at the supply reservoir inlet was 1.12 kPa (assuming water density to be 998 $kg/m^3$).

The prototype included a 1.19 mm hole through the rotor and stator. The hole in the stator allowed a shaft to pass through to the rotor while still being permitted to spin freely. A 1.19 mm stainless steel driveshaft was fixed to the rotor using clear epoxy and allowed to cure overnight. The shaft end opposite the rotor was fixed to a 2.39 mm shaft, also using epoxy. A control console was used to control motor velocity in increments of 1000 rpm. The motor was held in a vise with a vacuum base on a Plexiglas panel fixed to the bench plate. The motor output shaft was coupled to the 2.39 min shaft. An NSK model Z500 50,000 rpm vibration-free motor was used to drive the rotor. The setup also included a 2,500 rpm air motor with a filter-regulator-lubricator (FRL) system. Compressed nitrogen gas was used to drive the air motor.

A clear pump casing 14*a* was used so flow across the pump could be physically viewed for signs of cavitation. Acrylic bar stock was used for the casing. All sides of the acrylic bar stock were faced and a 6.5 mm through-hole was drilled axially into the center. To insurer proper fit, the housing was custom manufactured to the given set of pump parts. Using various grits of sandpaper and a brass rifle swab-holder, the housing inner diameter was gradually enlarged to allow a tight fit of the inlet guide and stator while allowing the rotor to spin freely. In addition two larger holes were drilled and tapped into the ends of the housing approximately 9.5 mm deep to accommodate the use of fittings for quick-change application. This was done so that if a pump failed during testing, the pump could quickly be replaced to allow testing to continue. Afterward, all interior and exterior surfaces were polished using a Novus three-stage plastic polishing kit. The exterior of the housing has no influence on pump flow characteristics, and was thus kept rectangular for manufacturing simplicity and flow visualization.

Figure 9A:
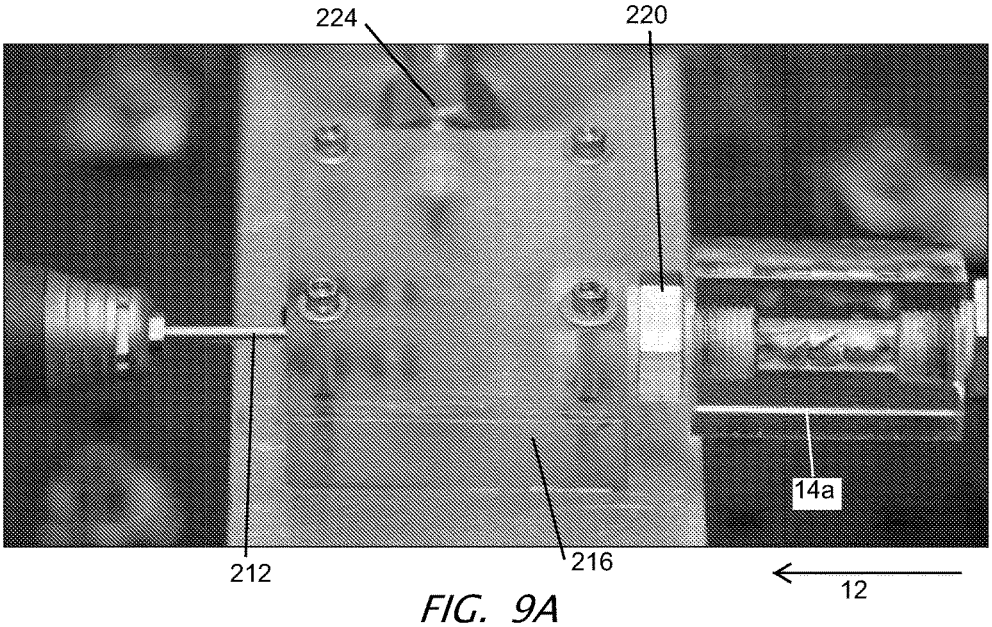
FIGS. 9A-9B depict the assembly used to test prototyped pumps.
Figure 9B:
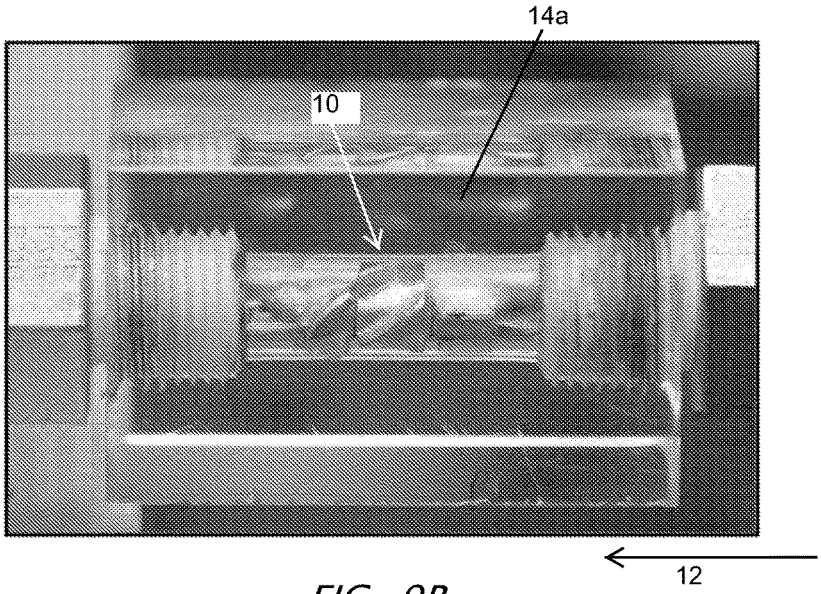

Loctite 454, a cyanoacrylate adhesive with a viscosity similar to gel, was used to secure the inlet guide and stator within the channel of the housing were casing. The gel-like viscosity was important to minimize adhesive bloom, which is the tendency of the adhesive to spread outward along a surface when it is applied. This minimized the possibility that adhesive might negatively influence the flow field. A 0.5 ml syringe with a wire gauge size of 23, 45° bent, blunt tip hypodermic needle was used to apply the adhesive directly to the inlet guide and stator vanes after the fit of the parts was confirmed in the acrylic casing. Some uncured adhesive caused some minor stress cracking in the acrylic casing; however, they formed only in regions where the inlet guide and stator vanes were in direct contact with the interior casing wall (surface 30) and thus did not cause any negative effects in the flow field. The completed pump assembly included a fixed inlet guide and stator, and a free spinning rotor and shaft assembly, all inside the acrylic casing. FIG. 9A is a photo of the completed test pump assembly that illustrates shaft 212 extending from the stator and through a second casing 216.

Casing 216 was also manufactured and configured to divert fluid to the measurement devices while driving the rotor. An elbow and stuffing box assembly was designed and manufactured from acrylic (for manufacturing simplicity) using UGS and a Roland MDX-20 rapid prototyping machine. FIG. 9A shows the actual casing 216 that was used with the pump assembly. Two bearings and four Buna-N AS568A-005 double seal o-rings were placed in the stuffing box to stabilize driveshaft 212 and minimize fluid leaking from the elbow and stuffing box assembly. Silicone grease was also packed into the bearing and seal chambers in the stuffing box section. Aquarium sealant was applied to seal the mating surfaces of the upper and lower elbow and stuffing box assembly halves and to prevent fluid leakage. As shown, casing 216 includes an inlet port 220, and outlet port 224 disposed noted angle relative to the inlet port 220, and defines a flow path with a 90° turn between inlet port 220 and outlet port 224, such that driveshaft 212 extends through the bearings and seals, through inlet port 220, and to the rotor.

Stainless steel tubing with an outside diameter of 9.5 mm and inside diameter of 9 mm was used because it matched closely to the inner diameter of the pump casing. The tubing was used to direct fluid from the supply reservoir to the pump, from the pump to all measurement devices and flow control valve, and finally to the discharge reservoir. A stainless steel needle valve was also installed in the circuit to control flow. Two measurement devices (pressure transducer and turbine flowmeter) were connected to a computer with LabView data acquisition systems were used for the testing. An Omegadyne Inc. PX-309-500G5V pressure transducer with range of 0-500 psi and output of 0 to 5V was used to measure pressure. Flow was measured with an Omegadyne Inc. FTB-9504 turbine flowmeter with a 50 to 1000 cc/min range and an output of 0 to 5V. The flowmeter was connected to an Omegadyne Inc. FLSC-61 signal conditioner. Both devices were installed at the same height as the pump. A high-speed camera capable of recording up to speeds of 10,000 fps was also set up to analyze rotor behavior.

From previous experiments on only the rotor, it was known that bleeding all lines and components of any trapped air would be important to ensure proper operation. Any air introduced to the system or trapped in the lines can inhibit and/or cause a total collapse in flow. Trapped air has a tendency to stick to pump components, even while in operation, and may impede flow. To bleed air from the system, a 60 ml syringe with a wire gauge size 14, 90° bent, blunt tip hypodermic needle was used to forcefully inject fluid through the lines and pump from the supply reservoir. Any trapped air bubbles were expelled into the discharge reservoir and the procedure was repeated until no bubbles were seen exiting the outlet of the discharge reservoir.

Additional testing was also performed with a similar, second test set up in a different primarily in the configuration of the flow-diverting casing. In particular, the flow-diverting casing used in the second test set up a first 90° band between the inlet and the pump, the pump channel itself, and a 2nd 90° band between the pump and the outlet. The second test set up also differed in that it utilized a KaVo Inc 625C SuperTorque dental drill to drive the rotor. Nitrogen gas was used to drive the drill, and a pressure regulator was used to control the dental drill speed. A no-contact tachometer was used to measure rotational speed of the rotor. The pump was coupled to the dental drill using a 1.19 mm stainless steel shaft fixed to the rotor, a black anodized 7.94 mm aluminum rod and a 1.6 mm high-speed steel drill blank. The drill blank was the exact diameter of burrs used for the drill in conventional dental practice and easily coupled the pump to the drill. The aluminum rod was used to couple the 1.19 mm shaft to the drill blank. A thin strip of reflective tape was attached to the aluminum rod to reflect: the laser from the tachometer. A Swagelok brand ¼ turn valve was used to manipulate flow. Additionally, the casing enclosed a metal sub-casing that housed the seals for the driveshaft.

3. Test Results

Table 1 lists the measured rates of discharge at different rotor speeds during free delivery operation. The pump achieved a maximum discharge of 25.08 ml/s at 50,000 rpm without noticeable cavitation. No radial vibration was observed during the entire operating envelop of the pump. A slight axial movement of the rotor was noticed during start up and very high rotor speed. A fluid thrust bearing can be added to minimize axial displacement. The pump shows a nearly linear discharge rate up to 50.000 rpm rotor speed. Table 2 list various measured and/or calculated pump characteristics obtained with the second test setup.

TABLE 1

| Experimental Data | |
|---|---|
| Pump Velocity, rpm | Flow Rate, ml/s |
| 10000 | 2.62 |
| 20000 | 10.64 |
| 30000 | 15.11 |
| 40000 | 20.20 |
| 50000 | 25.08 |

TABLE 2

Summary of Results Obtained with Second Test Apparatus

| Angular Velocity (RPM) | Free Flow Rate ($m^3/s$) | Free Flow Head (m) | Free Flow Pump Efficiency (approximate) | Shutoff Head (m) |
|---|---|---|---|---|
| 10,000 | 1.34E−06 | 0.12 | 0.06-0.07 | 0.15 |
| 20,000 | 2.77E−06 | 0.40 | 0.12-0.14 | 0.54 |
| 30,000 | 4.83E−06 | 0.43 | 0.13-0.45 | 0.94 |
| 40,000 | 6.01E−06 | 1.10 | 0.27-0.32 | 1.80 |
| 50,000 | 7.73E−06 | 2.28 | 0.50-0.60 | 3.15 |
| 60,000 | 8.87E−06 | 2.95 | 0.60-0.70 | 4.81 |
| 70,000 | 1.10E−05 | 4.84 | 1.00-1.20 | 6.60 |

Additional results of various tests on embodiments of the present pumps are described in [5], which is incorporated by reference in its entirety.

In addition to the embodiments described above, the following Design and Development section includes information a person of ordinary skill can use in designing and/or making additional embodiments of the present pumps.

4. Design and Development

As used in this disclosure, the following symbols correspond to the following definitions and units.

| Symbol | Definition | Units |
|---|---|---|
| $\dot{m}$ | Mass Flow Rate | $\frac{kg}{s}$ |
| Cm | Axial Component of Abs. Velocity | $\frac{m}{s}$ |
| $C_R$ | Chord Length (Rotor) | mm |
| $C_R1$ | Absolute Flow Velocity (Rotor inlet) | $\frac{m}{s}$ |
| $C_R2$ | Absolute Flow Velocity (Rotor outlet) | $\frac{m}{s}$ |
| $C_S$ | Rotor Vane Chord Length | mm |
| $C_S1$ | Absolute Flow Velocity (Stator inlet) | $\frac{m}{s}$ |
| $C_S2$ | Absolute Flow Velocity Stator outlet) | $\frac{m}{s}$ |
| $DF_R$ | Rotor Diffusion Factor | dimensionless |
| $DF_S$ | Stator Diffusion Factor | dimensionless |
| $D_H$ | Hub Diameter | mm |
| Dm | Mean Effective Diameter | mm |
| $D_I$ | Exit Tip Diameter | mm |
| fhp | Fluid horsepower | hp |
| g | Gravity | $\frac{m}{s^2}$ |
| He | Hydraulic Losses per Stage | m |
| IGV | Inlet Guide Vane | |
| L | Hub to Tip ratio | dimensionless |
| $L_R$ | Rotor Vane Axial Length | mm |
| $L_S$ | Stator Vane Axial Length | mm |
| M | Margin of Life | dimensionless |
| n | Number of Pump Stages | dimensionless |
| N | Pump Rotational Speed | rpm |
| NPSH | Net Positive Suction Head | m |
| NPSHa | Available Net Positive Suction Head | m |
| NPSHc | Critical Net Positive Suction Head | m |

-continued

| Symbol | Definition | Units |
|---|---|---|
| Nr | Rotational Speed | $\frac{rad}{s}$ |
| Ns | Stage-Specific Speed | $\frac{\frac{rad}{s} * \sqrt{\frac{m^3}{s}}}{m^{0.75}}$ |
| Pi | Inlet Pressure | bar |
| $P_R$ | Rotor Pitch | mm |
| $P_S$ | Stator Pitch | mm |
| Pv | Propellant Vapor Pressure | bar |
| Pw | Power | W |
| Q | Volumetric Flow Rate | $\frac{cc}{s}$ |
| Qe | Impeller Leakage Loss | $\frac{cc}{s}$ |
| Qimp | Impeller Flow Rate | $\frac{cc}{s}$ |
| r | Thoma Parameter | dimensionless |
| $R_1$ | Tangential Velocity (Rotor inlet) | $\frac{m}{s}$ |
| $R_2$ | Tangential Velocity (Rotor outlet) | $\frac{m}{s}$ |
| $R_R$ | Rotor Vane Curvature | mm |
| $R_S$ | Stator Vane Curvature | mm |
| $S_1$ | Tangential Velocity (Stator inlet) | $\frac{m}{s}$ |
| $S_2$ | Tangential Velocity (Stator outlet) | $\frac{m}{s}$ |
| $S_R$ | Rotor Vane Solidity | dimensionless |
| $S_S$ | Stator Vane Solidity | dimensionless |
| Um | Rotor Peripheral Velocity | $\frac{m}{s}$ |
| $us_S$ | Suction Specific Speed | dimensionless |
| $u_t$ | Impeller speed | $\frac{m}{s}$ |
| $V_R1$ | Relative Flow Velocity (Rotor inlet) | $\frac{m}{s}$ |
| $V_R2$ | Relative Flow Velocity (Rotor outlet) | $\frac{m}{s}$ |
| $Z_R$ | Number of Rotor Vanes | dimensionless |
| $Z_S$ | Number of Stator Vanes | dimensionless |
| $\alpha_1$ | Inducer Inlet angle | deg. |
| $\alpha_2$ | Inducer Outlet angle | deg. |
| $\beta_1$ | Rotor Inlet angle | deg. |
| $\beta_1'$ | Relative Rotor Inlet angle | deg. |
| $\beta_2$ | Rotor Outlet angle | deg. |
| $\beta_2'$ | Relative Rotor Outlet angle | deg. |
| βc | Rotor Chord angle | deg. |
| $\gamma_1$ | Stator Inlet angle | deg. |
| $\gamma_1'$ | Relative Stator Inlet angle | deg. |
| $\gamma_2$ | Stator Outlet angle | deg. |
| $\gamma_2'$ | Relative Stator Outlet angle | deg. |
| γc | Stator Chord angle | deg. |
| ΔH | Pump Head Rise | m |
| ΔHimp | Developed Head per Stage | m |
| ΔP | Pressure Rise | bar |
| ΔPps | Allowable Pressure Rise | MPa |

-continued

| Symbol | Definition | Units |
|---|---|---|
| ε | Contraction Factor | dimensionless |
| η | Pump Efficiency | dimensionless |
| ϕ | Inlet Flow Coefficient | dimensionless |
| ψ | Head Coefficient | dimensionless |
| ωp | Weight flow | $\frac{kg}{s}$ |

4.1 Design Synthesis

Figure 11:
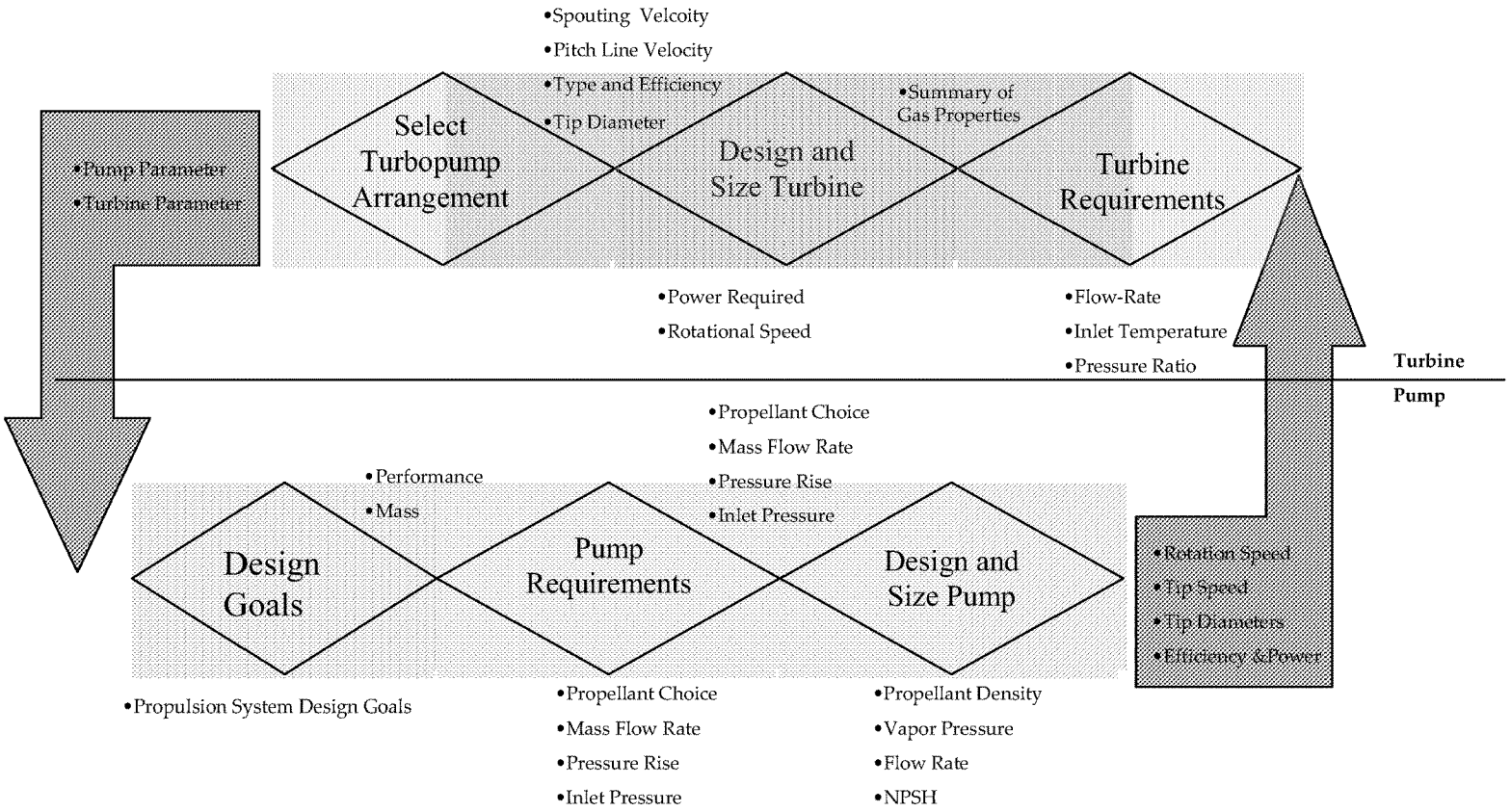
FIG. 11 depicts a flowchart of the initial design approach utilized for the prototyped embodiment.

The preliminary design analysis of the miniature pump was approached from the perspective of the overall design goals of the propulsion system. The iteration pathway for the design approach is shown in FIG. 11. The overall design objective of the propulsion system was to investigate the feasibility of developing pump fed systems for <300N class bipropellant thrusters. One example of an implementation for the present pumps is to use non-toxic propellants for safer ground handling and/or lower-cost space systems. The initial design points that were used are summarized in Table 3.

TABLE 3

Initial Design Envelope for Pump

| | |
|---|---|
| Propellant | Ethanol, RP-1, $H_2O_2$, MMH, $N_2O_4$ |
| Pressure Rise | 4-20 bar |
| Propellant Flow Rate | 0.1-5 ml/s; 5-25 ml/s, 25-70 ml/s |
| Pump Inlet Pressure | 1-6 bar |

Based on typical flow rates of different thrust class engines three ranges of propellant flow rate were selected. Table 4 shows propellant flow rates (based on theoretical performance) of a 4N class thruster (Nozzle Throat Width: 0.38 mm, Expansion Ratio: 25, Nozzle Half Divergence Angle: 15°, Chamber Length: 7.5 mm, Convergence Section Length: 2.5 mm, and Divergence Section Length: 13.5 mm) determined using shifting equilibrium calculations. A 4-20 bar pressure rise range was selected as the head requirement of the pump. Although the higher the pressure rise the better the specific impulse, the chamber pressure may often be constrained by the overall propulsion system optimization tasks. Thus the goal of the present work was to develop a miniature pump which is scalable to different chamber pressures, as in at least some of the present embodiments.

TABLE 4

Example with Flow Rates

| | |
|---|---|
| Thrust | 4N Class |
| Propellants | RP-1/$H_2O_2$ |
| Chamber Pressure | 4.5 bar |
| Mixture Ratio | 6.59 |
| Specific Impulse | 320 s |
| Volumetric Flow Rate of RP-1 | 0.20 ml/s |
| Volumetric Flow Rate of $H_2O_2$ | 0.79 ml/s |

For the initial design iteration, the pressure rise (ΔP) was set to 20 bar for ethanol with 6 bar of inlet pressure (Pi) and a volumetric flow rate (Q) of 70 ml/s. The maximum pressure and flow rate values within the range were chosen to test the upper limit of the proposed miniature pump technology.

The vapor pressure (Pv) and density (ρ) of ethanol are 0.15858 bar and 789 kg/m$^3$ [mass flow rate 0.5523 kg/s], respectively. The pump head rise can be calculated as:

$$\Delta H = \frac{\Delta P}{g * \rho} \quad [1]$$

The required head was found to be 258 m. The Net Positive Suction Head (NPSH) can be calculated using the following relation:

$$NPSH = \frac{Pi - Pv}{g * \rho} \quad [2]$$

The number of stages can be calculated as follows:

$$n \geq \frac{\Delta P}{\Delta Pps} \quad [3]$$

where the allowable pressure rise (ΔP) is 16 MPa for liquid Hydrogen or 47 MPa for all others [7]. In the present analysis, the allowable pressure rise per stage was estimated at 47 MPa.

To estimate the pump rotational speed two limiting criteria, suction specific speed and stage specific speed, were used:

$$Nr1 = \frac{u_{ss} * NPSH^{0.75}}{\sqrt{Q}} \quad [4]$$

$$Nr2 = \frac{Ns * \left(\frac{\Delta H}{n}\right)^{0.75}}{\sqrt{Q}} \quad [5]$$

The limiting value of $u_{ss}$ and $N_s$ were set at 70 and 3.0, respectively [7]. The lesser of the two numbers from equation [5] and [6] was used to determine the pump rpm [Equation 8]:

$$N = \frac{30 * Nr}{\pi} \quad [6]$$

The impeller tip speed was calculated using, the following relation. A value of 0.4 was used to set the limiting condition for the head coefficient (ψ) [7].

$$u_t = \sqrt{\frac{g * \Delta H}{n * \psi}} \quad [7]$$

The tip diameter of the rotor was calculated as follows:

$$D_t = \frac{2 * u_t}{Nr} \quad [8]$$

The hub diameter was determined using equation [9] with an inlet flow coefficient (ϕ) of 0.10, and a hub to tip ratio (L) of 0.3:

$$D_H = \sqrt[3]{\frac{(4/\pi)*Q}{\varphi*Nr*(1-L^2)}} \quad [9]$$

The pump efficiency was estimated based on the stage specific speed [Eqn. 10] and available data from the literature [7]. Table 5 lists the calculated parameters for the initial design point.

$$Ns = \frac{Nr*\sqrt{Q}}{(\Delta H/n)^{0.75}} \quad [10]$$

TABLE 5

| Calculated Pump Parameters | |
|---|---|
| Pump Head Rise, ΔH (m) | 258 |
| NPSH (m) | 75 |
| NPSHa (m) | 75 |
| NPSHc (m) | 63 |
| Pump Stages, n | 1 |
| Nr1 (rad/s) | 214229 |
| Nr2 (rad/s) | 23109 |
| Pump Rotational Speed, N (rpm) | 220677 |
| Pump Impeller Speed, $u_t$ (m/s) | 80 |
| Exit Tip Diameter, Dt (mm) | 6.89 |
| Hub Diameter (mm) | 3.49 |
| Stage Specific Speed, Ns ($\sqrt{(m^3/s)}/m^{0.75}$) | 3.0 |
| Efficiency, η | 0.84 |

The question then became what type of pump is suitable for this head and discharge condition. Conventional design guidelines based on specific speed and head coefficient range recommend any type of radial flow pump (such as centrifugal pump) [8]. However, several other factors were considered in order to miniaturize the pump technology. For instance, although the stage specific speed is 3.0, the actual rotational speed is above 200,000 rpm, which is beyond the capacity of any known electrical motor. Additionally such rotational speeds may create other constraints in terms of impeller cavitations, fabrication, alignments and tolerance control, rotor vibrations and bearing life. One solution considered was to divide the head rise among several stages and keep the rotational speed under 50,000 rpm. But staging may be difficult for centrifugal pumps due to inlet flow matching requirements between stages. In contrast, staging was found to be simpler for axial flow pumps. Additionally, axial flow pumps may have superior throttling behavior, and can be easier to fabricate in miniature form. Based on these and other considerations, an axial flow configuration was selected for the study.

4.2 Concept Development

Two different concepts of the miniature pump were developed: (i) motor driven and (ii) turbine driven. Most of the components of the motor driven and turbine driven concepts are identical except the stator section of the motor driven pump is longer to house the motor. FIG. 10 shows the CAD model of the 'motor driven' concept. The pump has three distinct sections: (i) inlet guide vanes (IGV), (ii) rotor, and (iii) stator. Tire inlet guide vanes and the stator hubs house the bearing support for the rotor. In the embodiment shown, structural support pins fix the inlet guide vanes and the stator vanes with the pump casing, and the stator hub contains the motor housing and the coupling mechanism.

Table 6 lists various dimensions of the miniaturized pump. The design of the rotor vane was derived from the 'initial design point' of the pump. Direct scaling of various design relations for the axial-flow pump is used to calculate the vane parameters [FIG. 12]. For staging, the identical rotor and stator sections can be repeated for a desired number of stages.

TABLE 6

| Pump Dimensions (in mm) | | | | | | | | |
|---|---|---|---|---|---|---|---|---|
| | Length | | | | Radius | | | |
| | Cap | Shaft | Vane | Body | Shaft | Inner | Minor | Major |
| Inducer | 1.68 | — | 4.15 | — | — | 1.63 | 1.75 | 3.15 |
| Rotor | — | 1.00 | 4.15 | — | .48 | — | 1.75 | 3.15 |
| Stator | 1.70 | — | 4.15 | 7.00 | — | 1.63 | 1.75 | 3.15 |
| Bearing | — | — | — | 1.00 | — | 1.00 | — | 3.00 |
| Motor | — | 1.30 | — | 5.50 | 0.24 | — | — | 1.90 |

Figure 12:
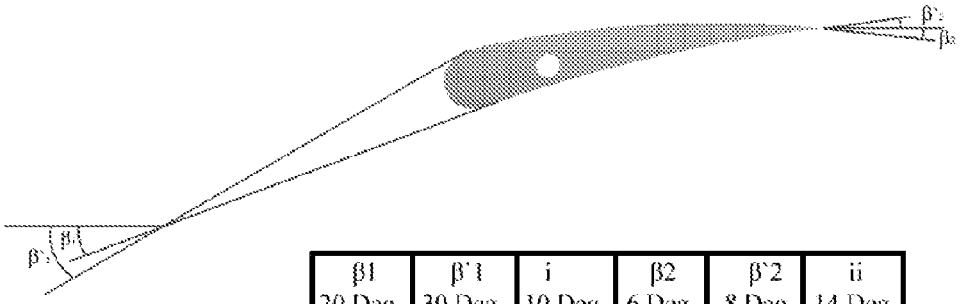
FIG. 12 depicts initial rotor vane geometry used to develop the prototype.

The stator vane geometry shown in FIG. 12 is a first order calculation and was optimized through subsequent CFD and experimental analysis of the laboratory prototype. The following sections detail the sizing calculations of the pump components for the prototyped embodiment.

4.3 Vane Geometry

The calculated pump parameters [Table 5] were used to develop the geometry of rotor and stator vanes. The mean effective diameter (Dm) and pitch ($P_R$) were calculated as follows.

$$Dm = 0.5(Dt^2 + D_H^2) \quad [11]$$

$$P_R = \frac{\pi*Dm}{Z_R} \quad [12]$$

where, $Z_R$ is the number of rotor vanes desired. Equation [13] was used to determine the vane chord length ($C_R$) [9].

$$S_R = \frac{C_R}{P_R} = 0.875 \quad [13]$$

The chord angle (βc) is required to give a measurement of the vanes curvature.

$$\beta c = 0.5(\beta 1 + \beta 2) \quad [14]$$

As shown in the above equation, in order to calculate the chord angle the rotor inlet ($\beta_1$) and outlet ($\beta_2$) angles were used. The rotor inlet and outlet angles were estimated based on current design guidelines of axial flow pumps. Using the chord angle and the vane chord length, the axial length ($L_R$) of the rotor can be calculated as follows:

$$L_R = C_R * \sin(\beta c) \quad [15]$$

The radius of the rotor vane curvature ($R_R$) was calculated using equation [14]

$$R_R = \frac{C_R}{2*\sin[0.5*(\beta 2 - \beta 1)]} \quad [16]$$

The angle of attack at the inlet and discharge deviation angle at the outlet of the rotor vanes were chosen as 6° and 10°, respectively. Using these angles the relative flow angles can be calculated using the following relations:

$$\beta'_1=\beta_1-i \quad [17]$$

and $$\beta'_2=\beta_2-ii \quad [18]$$

The impeller flow rate at the rated design point can be determined as follows:

$$Qimp=Q+Qe \quad [19]$$

where, $$Qe=0.1*Q \quad [20]$$

Equation [20] estimates the impeller-leakage loss [9]. The axial component of the absolute velocity can now be calculated using the relation below:

$$\mathrm{Cm} = \frac{Qimp}{(3.12*(Dt^2 - D_H^2)*\varepsilon)/4} \quad [21]$$

Where ε is the contraction factor. The contraction factor is a ratio of the effective flow area to the geometric area. This factor accounts for the flow blockage at the hub and tip due to the buildup of the boundary layers. In the present analysis, ε=0.9 was used for the preliminary calculation [9]. The contraction factor will be recalculated later from the CFD data. The rotor peripheral velocity at the mean effective diameter was:

$$Um = \frac{N*Dm*\pi}{720} \quad [22]$$

The relative velocities at the rotor inlet and discharge can be calculated as follows:

$$V_R I = \frac{\mathrm{Cm}}{\sin(\beta 1)} \quad [23]$$

and $$V_R 2 = \frac{\mathrm{Cm}}{\sin(\beta 2)} \quad [24]$$

The tangential component of the inlet flow velocity of the rotor, $R_1$, depends on the outlet angle of the inducer ($\alpha_2$). The first version of the pump does not have an inducer section due to higher inlet pressure. Thus $\alpha_2$ has a value of 90° due to straight inlet guide vanes.

$$R_1 = \frac{\mathrm{Cm}}{\tan(\alpha_2)} \quad [25]$$

The outlet tangential component of the velocity, or $R_2$, can be calculated two ways: one is using the outlet angle of the rotor while the other involves the inlet angle of the stator ($\gamma_1$). However, the inlet angle of the stator is not known so the first method was used.

$$R_2 = Um - \frac{\mathrm{Cm}}{\tan(\beta_2)} \quad [26]$$

Once the outlet tangential component is calculated, the stator inlet angle can then be determined as follows:

$$\gamma_1 = \tan^{-1}\left(\frac{\mathrm{Cm}}{R_2}\right) \quad [27]$$

Using the inducer outlet angle, the absolute flow velocity for the rotor inlet ($C_R1$) can be determined. However, since the outlet angle is 90°, the value of $C_R1$ should equal the Cm of the rotor. Thus the following equation was primarily used to ensure that the previous assumption was valid.

$$C_R 1 = \frac{\mathrm{Cm}}{\sin(\alpha_2)} \quad [28]$$

To calculate the absolute flow velocity at the outlet of the rotor, or $C_R2$, the stator inlet angle was needed. The calculated $C_R2$ and the $R_2$ were used as the inlet absolute flow velocity for the stator $C_s1$ and the inlet tangential velocity for the stator ($S_1$), $$C_R 2 = C_S 1 = \frac{\mathrm{Cm}}{\sin(\gamma_1)} \quad [29]$$

Calculated values for all vane parameters are listed in Table 7.

TABLE 7

| Impeller Rotor Properties | |
|---|---|
| Mean Effective Diameter, Dm (mm) | 5.46 |
| Rotor Pitch, $P_R$ (mm) | 4.29 |
| Chord Length, $C_R$ (mm) | 3.75 |
| Inlet Angle, $\beta_1$ | 30.00 |
| Outlet Angel, $\beta_2$ | 76.00 |
| Chord Angel, βc | 53.00 |
| Axial Length, $L_R$ (mm) | 2.99 |
| Radius of Curvature, $R_R$ (mm) | 4.80 |
| Inlet Relative Angel, $\beta'_1$ | 20.00 |
| Outlet Relative Angel, $\beta'_2$ | 70.00 |
| Impeller Leakage Loss, Qe (cc/s) | 7.00 |
| Impeller Flow Rate, Qimp (cc/s) | 77.00 |
| Axial Flow Component, Cm (m/s) | 9.68 |
| Peripheral Velocity, Um (m/s) | 63.09 |
| Inlet Relative Velocity, $V_R1$ (m/s) | 19.36 |
| Outlet Relative Velocity, $V_R2$ (m/s) | 9.98 |
| Inlet Tangential Velocity, $R_1$ (m/s) | 0.00 |
| Outlet Tangential Velocity, $R_2$ (m/s) | 60.69 |
| Inlet Abs. Flow Velocity, $C_R1$ (m/s) | 9.68 |
| Outlet Abs. Flow Velocity, $C_R2$ (m/s) | 61.49 |

Figure 13:
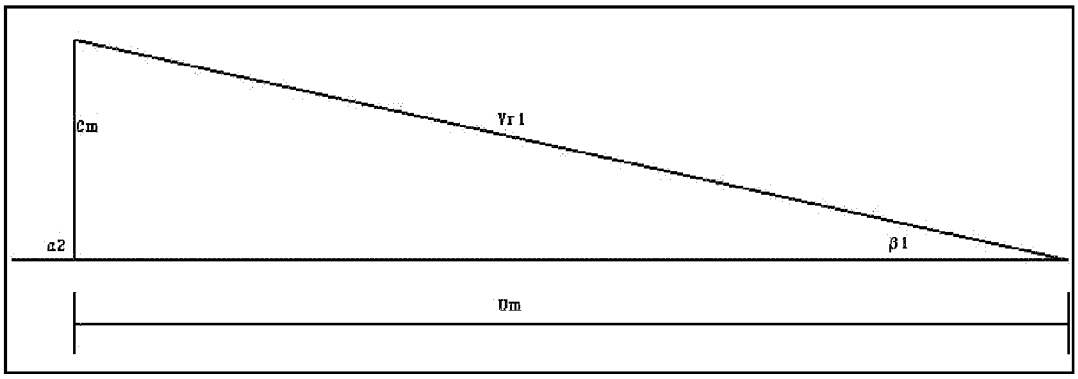
FIG. 13 depicts an ideal inlet velocity triangle for rotor.
Figure 14:
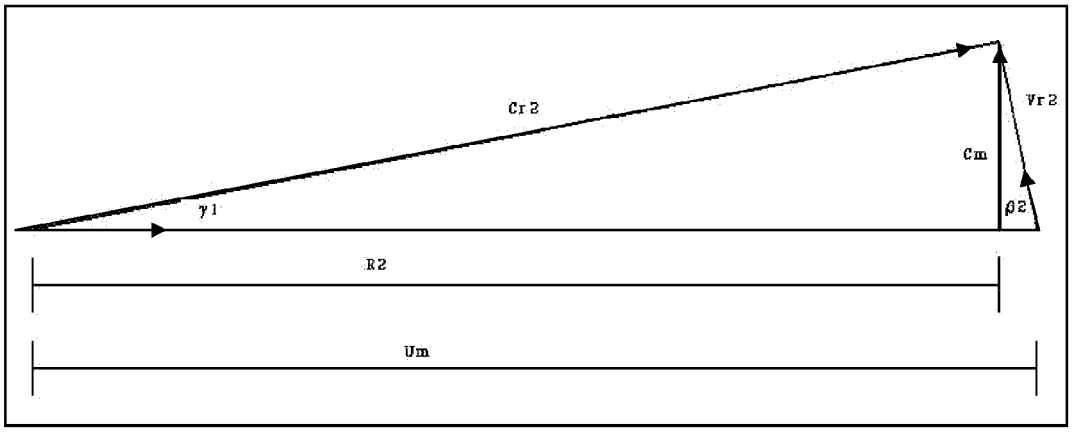
FIG. 14 depicts an ideal outlet velocity triangle for the rotor.

Using the calculated velocity components for the rotor, the ideal velocity triangles were drawn. The velocity triangles were used to relate the blade design parameters to the flow properties. In order to draw the inlet diagram, the inlet angle of the rotor ($\beta_1$) and the outlet angle of the inlet guide vanes ($\alpha_2$) were needed. Since the inlet guide vane angles were set to 90°, there was no tangential component of the relative velocity at the inlet. FIG. 13 shows the ideal inlet velocity triangle of the rotor. FIG. 14 shows the outlet velocity diagram of the rotor.

The design steps for the stator were similar to the rotor. The stator inlet angle was determined from the rotor analysis. The stator outlet angle has an inverse relation with the tangential and the absolute flow velocity components. Therefore, as the outlet angle increases the tangential and absolute flow velocities decrease. In the present analysis, an outlet angle range of 65° to 85° was considered. The angle was later optimized later using the CFD analysis. The stator chord length ($C_S$), chord angle (γc), axial length of the stator vane ($L_S$), radius of stator vane curvature ($R_S$), and stator relative flow angles ($\gamma_1'$, $\gamma_2'$) were calculated using the same procedure as described in the rotor section.

The outlet absolute velocity, or $C_S2$, can be calculated using the outlet stator angle as shown below:

$$C_S2 = \frac{\text{Cm}}{\sin(\gamma_2)} \quad [30]$$

The tangential velocities can be found using the following equations [32] for the inlet:

$$S_1 = \frac{\text{Cm}}{\tan(\gamma_1)} \quad [31]$$

The outlet tangential velocity was calculated as:

$$S_2 = \frac{\text{Cm}}{\tan(\gamma_2)} \quad [32]$$

The calculated stator parameters are listed in Table 8

TABLE 8

| Impeller Stator Properties | |
|---|---|
| Mean Effective Diameter, Dm (mm) | 5.46 |
| Stator Pitch, $P_S$ (mm) | 4.29 |
| Chord Length, $C_S$ (mm) | 3.75 |
| Inlet Angle, $\gamma_1$ | 9.06 |
| Outlet Angle, $\gamma_2$ | 85 |
| Chord Angle, γc | 47.03 |
| Axial Length, $L_S$ (mm) | 2.75 |
| Radius of Curvature, $R_S$ (mm) | 3.05 |
| Inlet Relative Angle, $\gamma'_1$ | −0.94 |
| Outlet Relative Angle, $\gamma'_2$ | 79 |
| Axial Flow Component, Cm (m/s) | 9.68 |
| Peripheral Velocity, Um (m/s) | 63.09 |
| Inlet Tangential Velocity, $S_1$ (m/s) | 60.71 |
| Outlet Tangential Velocity, $S_2$ (m/s) | 0.85 |
| Inlet Abs. Flow Velocity, $C_S1$ (m/s) | 61.49 |
| Outlet Abs. Flow Velocity, $C_S2$ (m/s) | 9.72 |

Figure 15:
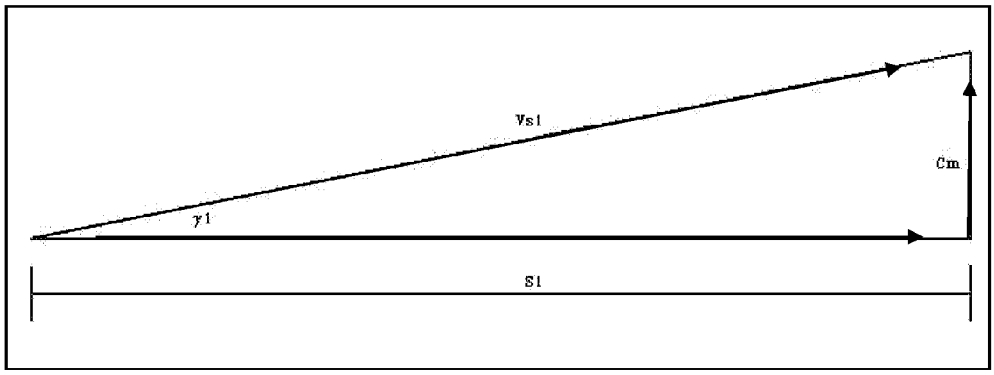
FIG. 15 depicts an ideal inlet velocity triangle for the stator.
Figure 16:
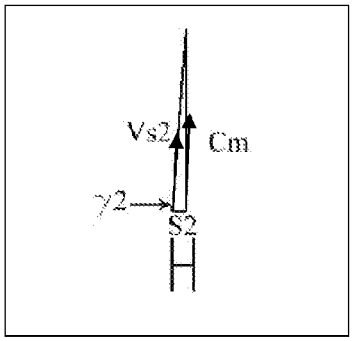
FIG. 16 depicts an ideal outlet velocity triangle for the stator.
Figure 17:
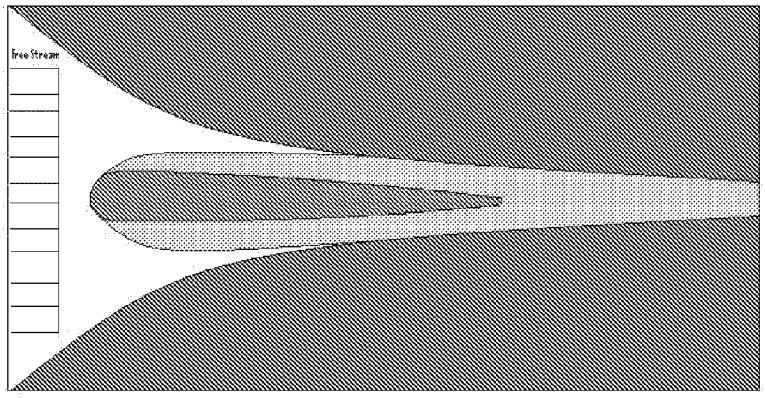
FIG. 17 depicts CFD results for boundary layer growth interactions for one of the present embodiments.

FIGS. 15 and 16 show the velocity diagram at the stator inlet and the stator outlet respectively. The developed head per impeller stage (ΔHimp) was calculated as:

$$\Delta Himp = \frac{Um*(R_2 - R_1)}{g} \quad [33]$$

The hydraulic loses per stage of the stator (He) was estimated as:

$$He = \Delta Himp - \Delta H \quad [34]$$

The diffusion parameter is an experienced based parameter, which takes into account the flow velocities and the vane solidities to determine the stall margin. A reasonable established stall margin is considered to be from 0.45 to 0.55[9]. Designs that have a higher parameter than those in the margin have been used in the past. However, they will experience a significantly smaller unstalled flow range. The methods used for calculating the diffusion parameter for the impeller rotor ($DF_R$) and stator ($DF_S$) can be seen below:

$$DF_R = \frac{1 + (V_R2/V_R1) + (R_2 - R_1)}{2*S_R*V_R1} \quad [35]$$

and $$DF_S = \frac{1 + (C_S2/C_S1) + (S_2 - S_1)}{2*S_S*C_S1} \quad [36]$$

The values for the final pump design parameters can be seen in Table 9.

TABLE 9

| Final pump parameters | |
|---|---|
| Developed Head per stage, ΔHimp (m) | 390 |
| Hydraulic Losses per stage, He (m) | 132 |
| Rotor Diffusion Factor, $DF_R$ | 1.8 |
| Stator Diffusion Factor, $DF_S$ | 0.55 |

It can be readily seen that the rotor diffusion factors in the present analysis was outside the range. However, extensive CFD and experimental analysis was performed at a later stage of the design process to study the scaling behavior of this parameter. The empirical correlations were extrapolated to cover the range of operating conditions used in the present design. The computed pump parameters are listed in Table 10.

TABLE 10

| Computed Pump Parameters | |
|---|---|
| Head Pump Rise, H (m) | 258 |
| NPSH (m) | 75 |
| Pump Stages | 1 |
| Nr1 (rad/s) | 214000 |
| Nr2 (rad/s) | 23100 |
| Nr (rad/s) | 23100 |
| Pump Rotational Speed, N (rpm) | 221000 |
| Pump Impeller Speed, u (m/s) | 80 |
| Exit Tip Diameter (mm) | 6.90 |
| Hub Diameter (mm) | 3.40 |
| Stage Specific Speed, Ns | 3 |
| Efficiency, η | 0.84 |
| Power, P (W) | 167 |

5. Design Analysis

Structural and fluid dynamics analyses of some critical components were performed prior to full scale tests of the miniature pump design. The objective of the structural analysis was to investigate the structural integrity and material requirements of the rotor at high rotational speeds. Fluid dynamic analyses of inlet guide vanes were used to understand the scaling behavior and to optimize the inlet guide vanes, rotor and stator geometries. High speed rotational tests were performed to determine the cavitation dynamics and vibrational characteristics of the rotor. The following sections discuss the various analyses performed on the miniature pump components. The fabrication techniques of those components are presented in Section 1. above.

5.1 Structural Analysis of the Rotor

Prior to the fluid dynamic optimization process of the rotor, the structural integrity of the rotor design was evaluated. von Mises stress ($\sigma_{max}$) on the rotor [Titanium and Inconel 706 as rotor materials] was computed with the structural finite element code Optistruct™ at the initial design conditions [H=258 m, Q=70 cc/s, N=221000 rpm]. As expected, the stress was concentrated at the root of the rotor vane trailing edge. However, the maximum stress values [$\sigma_{max}$=17 MPa for Titanium model and $\sigma_{max}$=30.7 MPa for Inconel 706 model] were well within the yield limit of Titanium ($\sigma_{\gamma}$~140 MPa) and Inconel 706 ($\sigma_{\gamma}$~1100 MPa).

Based on the computational fluid dynamics analysis (CFD) the rotor design was subsequently modified (inlet and outlet vane angles and chord thickness), and additional finite element analyses were performed to verify the structural integrity of the modified rotor design. von Mises stress ($\sigma_{max}$) on the revised rotor [Titanium and Inconel 706 as rotor materials] was computed with the structural finite element code Optistruct™ at the design conditions [H=258 m, Q=70 cc/s, N=221,000 rpm]. The maximum stress values [$\sigma_{max}$=14 MPa for Titanium model] were well within the yield limit of Titanium ($\sigma_{\gamma}$~140 MPa).

5.2 Fluid Dynamic Testing and Evaluation

The fluid testing and evaluation phase of the project comprises three tasks: (i) CFD analysis of the pump components for fluid dynamics optimization, (ii) water tunnel experiments to generate bench marking data for CFD analysis, and (iii) cavitation dynamics analysis of the rotor.

5.2.1 Computational Fluid Dynamics Modeling

To understand the fluid dynamic scaling of the pump, a set of individual simulations was performed for each of the pump stages. The CFD results allowed for establishing critical dimensions below which viscous effects were significant to limit the use of standard design procedures. Results from such analyses were also validated with experimental measurements. For the inlet guide vane (IGV) stage, five simulations [Table 11] were performed at a constant characteristic velocity and decreasing dimensions [3×, 2×, and 1×].

The IGV was designed to condition the flow before it enters into the rotor stage and to provide the structural support for the rotor assembly. It was observed that for 1.times. model the flow was accelerating inside the IGV in expense of inlet pressure. Due to the small distances between surfaces inside the pump, boundary layer interaction [shown in the FIG. 3.3] caused an acceleration of fluid in the core flow. As the free stream approached the closely spaced faces of the vanes and the housing, it created an internal flow between them as the respective boundary layers grew and eventually met. The increased velocity resulted in an overall pressure drop across the inlet guide vanes. The implication being that the rotor will experience non-uniform pressure and velocity distributions. The CFD study presented below demonstrates the limit dimension of the IGV at which this phenomenon becomes important to create performance loss.

TABLE 11

Iteration Conditions on IGV

| Iteration No. | Condition | Nominal Diameter |
|---|---|---|
| 1 | 3-X model with initial velocity of 2 m/s | 20.67 mm |
| 2 | 2-X model with initial velocity of 2 m/s | 13.78 mm |
| 3 | 1-X model with initial velocity of 2 m/s | 6.88 mm |

Figure 18:
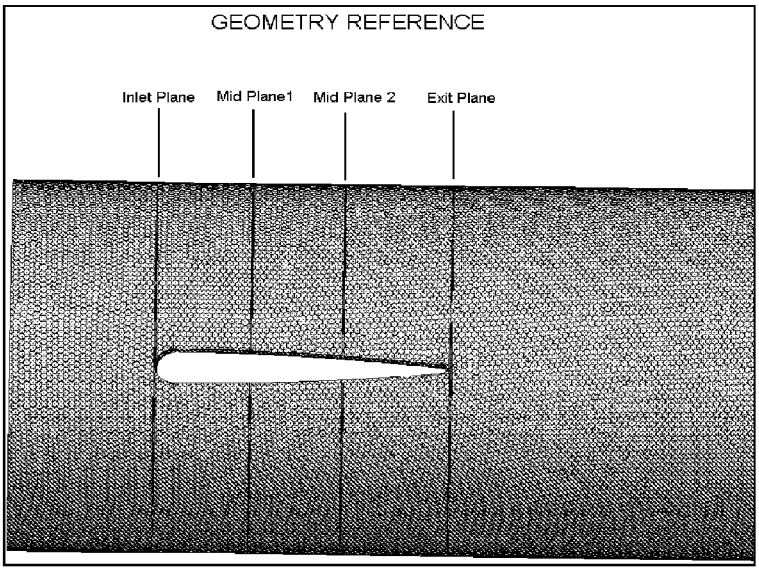
FIG. 18 depicts an inlet guide vane schematic for orienting reference planes used to model and measure fluid flow around inlet guide vanes.
Figure 19:
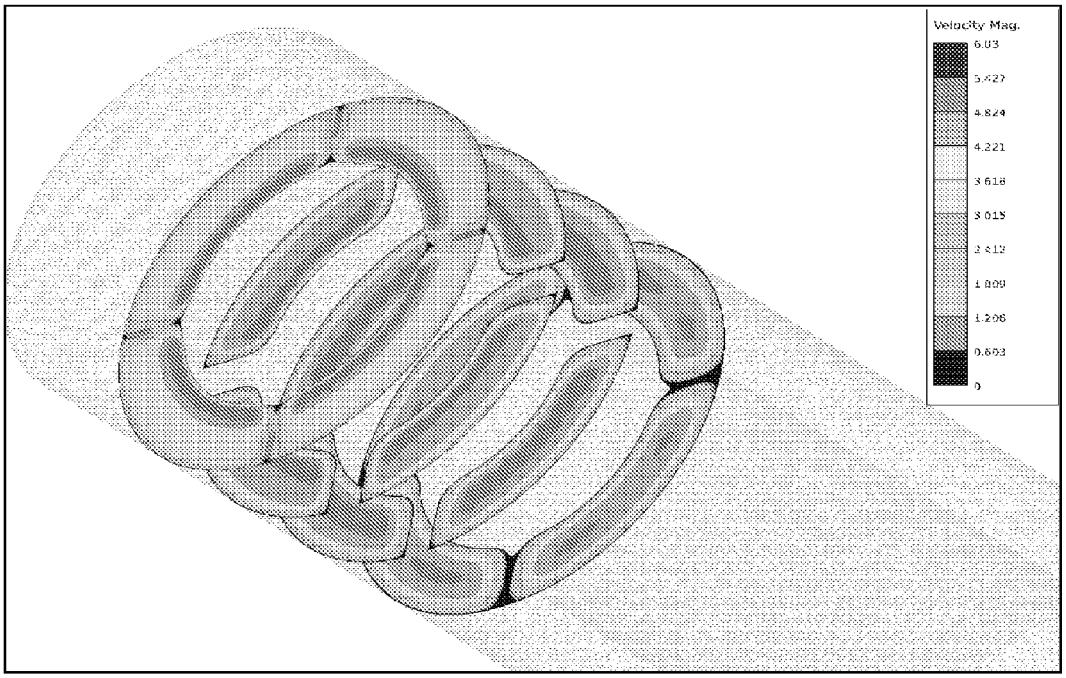
FIG. 19 depicts results of computational fluid dynamic (CFD) modeling of 3× inlet guide vanes at an initial velocity of 2 meters per second (2 m/s).
Figure 20:
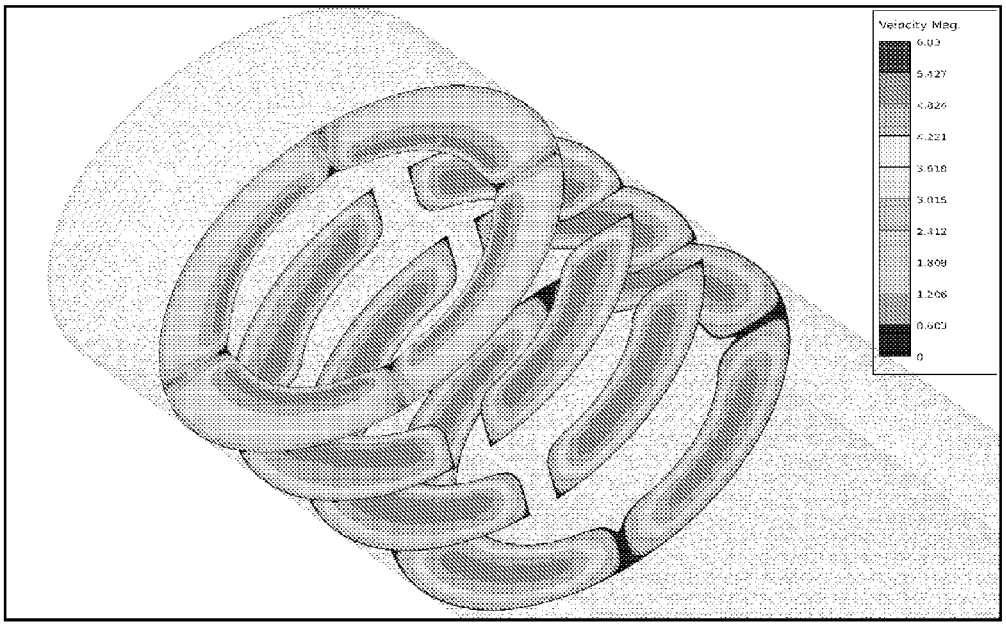
Figure 21:
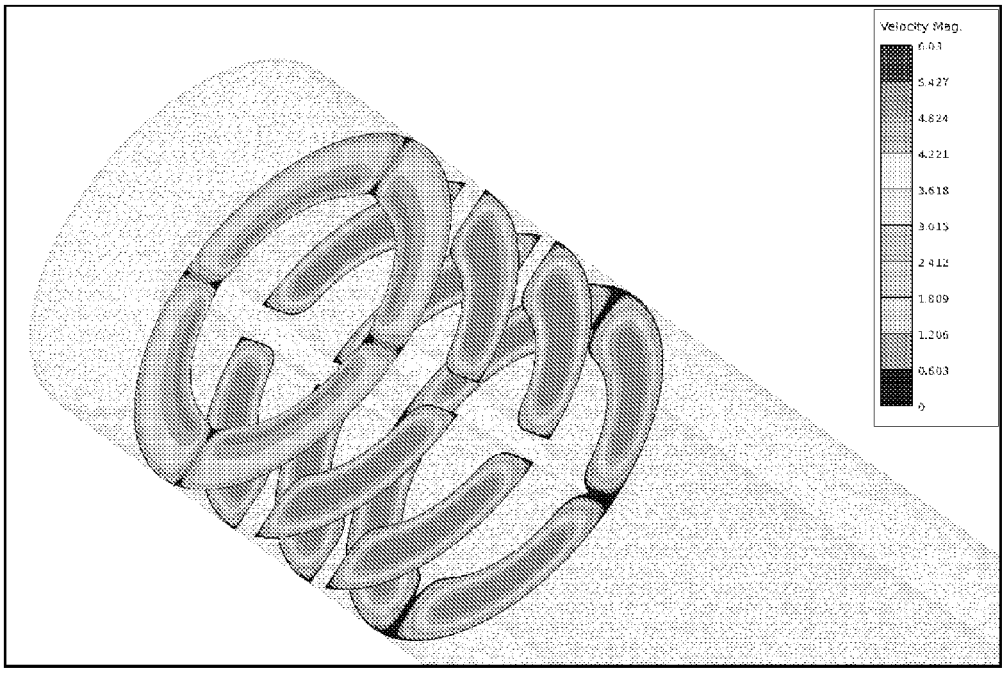
FIG. 21 depicts results of computational fluid dynamic modeling of 1× inlet guide vanes at an initial velocity of 2 meters per second (2 m/s).

The mesh used was polyhedral for all the simulations, and was within the range of 1-2% of the model size. The regions' conditions remained constant; only the initial conditions of the velocity were altered. The walls were set with the no-slip condition; the outlet was a single flow-split region with a ratio of one. Care was taken to ensure geometric similarity between the models. Three iterations were performed on the inlet guide vanes as described by Table 11, and a geometry reference picture is shown in FIG. 18 to display the position of the contour planes. In FIGS. 19-21, several contour planes are shown for each IGV model to delineate, the flow development.

FIG. 19 shows a gradual acceleration over the IGV up to 66% of the chord. The exit plane distribution shows a deceleration from 66% of chord but a maximum deviation from the free stream velocity of 3.427 m/s. This velocity increase is due to boundary layer interactions as the chord length progresses. FIG. 20 shows the 2× model, which displays the same trend as the previous model. The only difference is that the velocity acceleration is not continuous when compared to the 3× model. In addition, the concentration of the accelerating fluid is shown to be greater at the exit plane than that of the 3× model. FIG. 21 shows the flow development inside the 1× model. Due to the severe decrease in the IGV diameter, the acceleration versus chord length was violent at the exit plane when compared to the previous two models.

Figure 22:
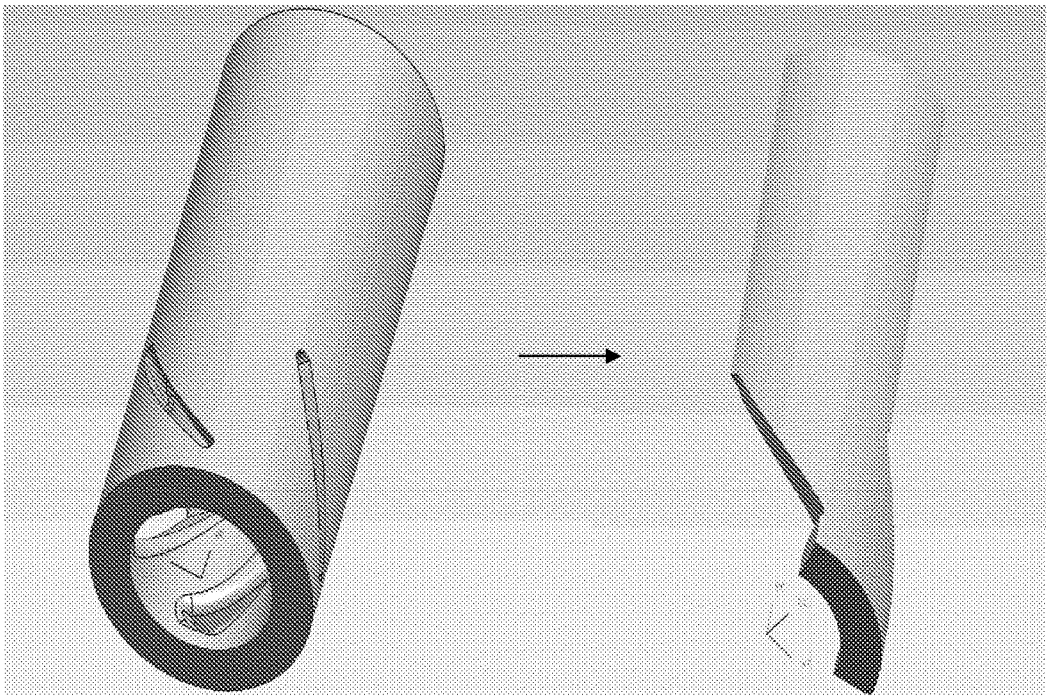
FIG. 22 depicts rotor geometry manipulation for CFD analysis optimization.

For the second stage of the pump (rotor), a more complex simulation was required. Furthermore, time taken for the solver to achieve the required iteration was also longer. In order to optimize the speed of the solver, a unique procedure was followed. The model geometry for the rotor was periodically repeated around the axis of rotation, that is, the four vanes used to propel the fluid were identical in size and shape. The model was then transformed into quarter regions, which only included one passage of the fluid per region, as shown below. By doing so, and having the correct boundary conditions, the solver can interpret such model as a whole, and not as a quartered region. Once the region was obtained, a polyhedral mesh was generated using no slip wall conditions for the vane faces, as well as for the casing and hub of the model. A fully developed periodic interface was used to can the quarter region into the entire rotor [FIG. 22].

Figure 23:
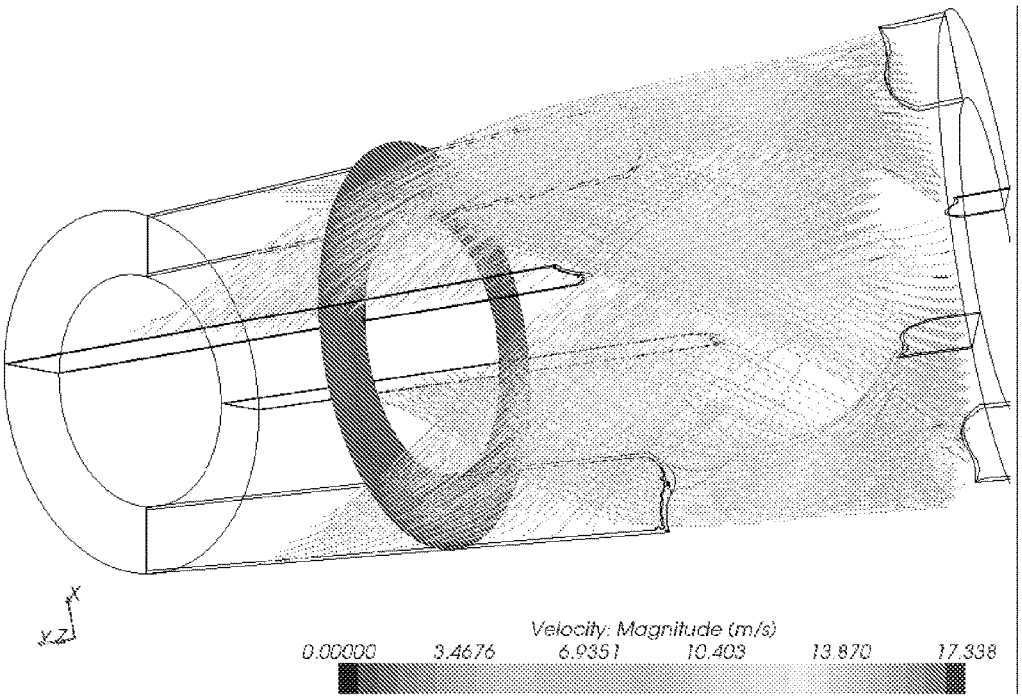
FIG. 23 depicts CFD modeled streamline flow at an initial velocity of 5.8 m/s.

Initially, only one simulation was partially successful on the rotor stage. A steady state problem, with the rotating blades fixed was performed to obtain the amount of swirl provided under no rotation. The model was simplified so that the time required for the simulation to run could be decreased. A few problems were encountered after a certain number of iterations where the solver apparently stopped detecting the interface. Before this point, a steady solution can be observed; the results shown are a contour plot after the rotor vanes, as well as streamline visualization. The initial flow condition was chosen at 5.8 m/s due to the velocity increase witnessed at the exit plane of the inlet guide vanes from the previous simulations. As observed in the contour plot, the solver detects the interface and performs the calculations as if it was the entire model [FIGS. 23-24]. These simulations were used to optimize the geometry of the rotor vanes.

5.2.2 Experimental Measurements.

A water tunnel with small test section and highly conditioned flow was used to validate the CFD data. The water tunnel utilized for these experiments was designed and built to encompass the non-invasive forms of analysis for the meso-scale inlet guide vanes. The miniature water tunnel was designed to be a closed piping network so that the water could be recirculated from a 208.2 liter plastic drum, which served as the reservoir, with an end suction centrifugal pump. The pump was rated by the manufacturer, Omega Engineering Inc., as being able to supply up to 454.2 lpm, which was sufficient for the benchmark tests. The working fluid used was water, which was first sent through a filter to ensure that no sediments would be brought into the system. The use of the filter and the closed network was also to ensure that no outside debris would contaminate the system.

Figure 24:
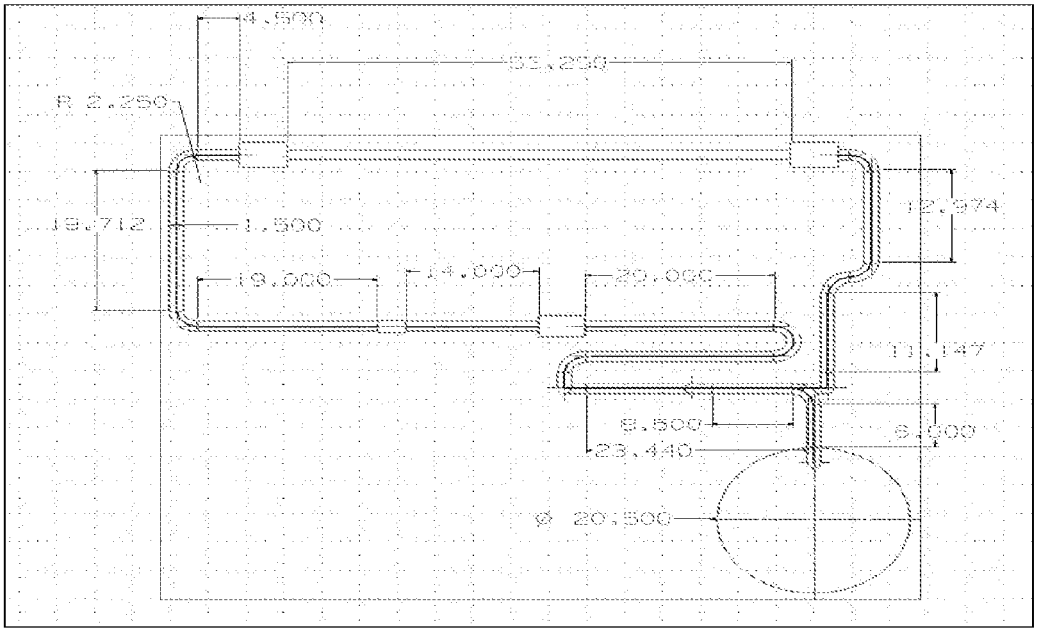
FIG. 24 depicts a CFD modeled steady velocity contour after the rotor blades at an initial velocity of 5.8 m/s.

The network system was constructed using 38.1 mm diameter PVC pipes. A back flow system was also designed into the setup that allows the direction of the flow to be manipulated within the test section. The test section itself was a 31.75×31.75×1353 mm square acrylic tube. This allowed the inlet guide vanes to be readily viewable from any angle and provided means for detecting any compromises within the section. For example, such compromises could be cracks on the inner part of the test section, or if the inlet guide vanes were to become dislodged from the mount. At the entrance of the test section, flow straighteners were added to minimize the flow fluctuations. They were comprised of hexagonal brass tubes; each tube was approximately 30 mm in length. One restriction that had to be maintained during the design and later the construction of the setup was that the flow meter utilized requires a predetermined length of pipe upstream and downstream in order to maintain accurate readings. The flow meter used was from Omega Engineering, Inc. and had been calibrated by the manufacturer for flow rates varying from 37.9-378.5 lpm. The lengths of pipe to be maintained before and after the flow meter were 0.51 m and 0.25 m, respectively. FIG. 24 shows the schematics of the setup.

Figure 25:
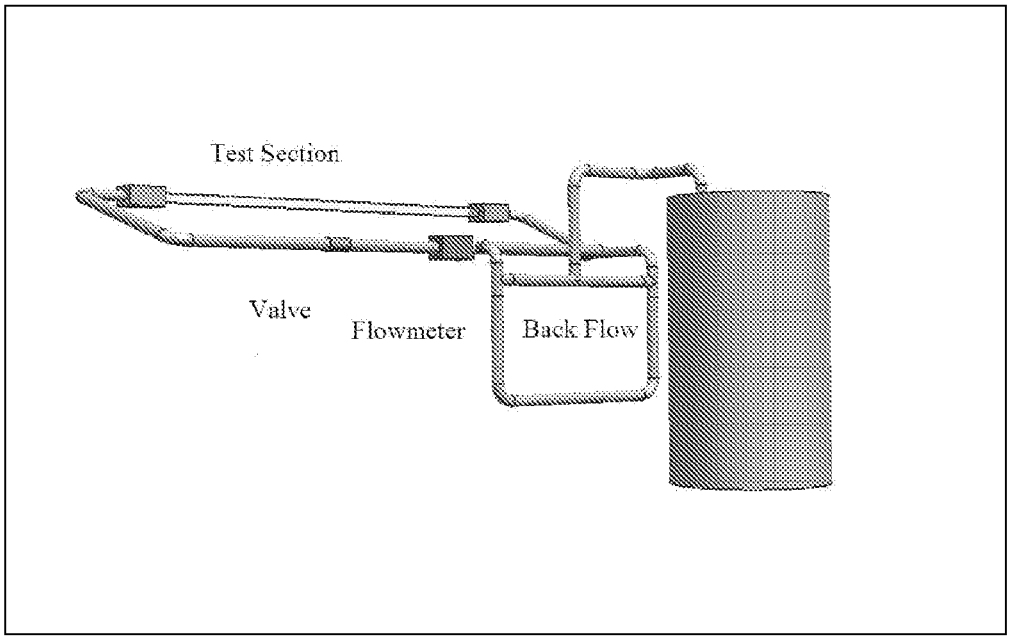
FIG. 25 depicts a plan view schematic of a water tunnel used to test the prototype.

The network leading up to the test section was also designed so that the section itself could sit 15.2 cm off the top of the table. This allocated room for the traverses that were to be used in later experiments. However, after reviewing the design, it was revised to add a threaded union on either side of the test section, so if either the test section were changed out or the pipes that connected it, it could be done quickly without altering the rest of the setup. A three dimensional view of the setup is shown in FIG. 25. Once the experimental setup was constructed, an analytical approach was taken to find the optimal test point within the section. The first step was to calculate the Reynolds number (Re) from equation [37] below for the test section. In order to perform this calculation the walls of the section were assumed smooth in order to minimize frictional losses. The density of water ($\rho_{water}$) and the kinematic viscosity of water at 20° C. ($\nu_{20°\,C.}$) were taken at 20° C. while the velocity of the water ($\nu$) was assumed at three different velocities. The hydraulic diameter of the test section ($D_h$) was calculated using equation [38] also shown below.

$$Re = \frac{V * D_h}{\upsilon_{20°C.}} \quad [37]$$

$$D_h = \lim_{b \to 1} \frac{4 * (2bh)}{2b + 4h} \quad [38]$$

The three Reynolds numbers calculated ranged from 42000 to 55000, which are in the turbulent range. This in turn influenced the equation that was used to determine the entrance length of the section. The entrance length ($L_e$) determines the length of the section it would take for the flow to be fully developed. Equation 39 was utilized to determine the entrance length for the three Reynolds numbers [3].

$$\frac{L_e}{D_h} \approx 4.4 * Re_d^{1/6} \quad [39]$$

The calculated entrance lengths ranged from 0.66 to 0.69 meters. In order to determine the percentage of the section that is occupied by the entrance length, the $L_e$ must be divided by the total length of the section. The percentage varied from 48% to 50%, which means that the optimal location would be from the midpoint of the test section to the exit portion of the test section. Once these calculations were preformed, qualification tests were performed in order to verify the analytical results and determine the optimal location for testing.

5.2.3 Water Tunnel Qualification Tests

Figure 26:
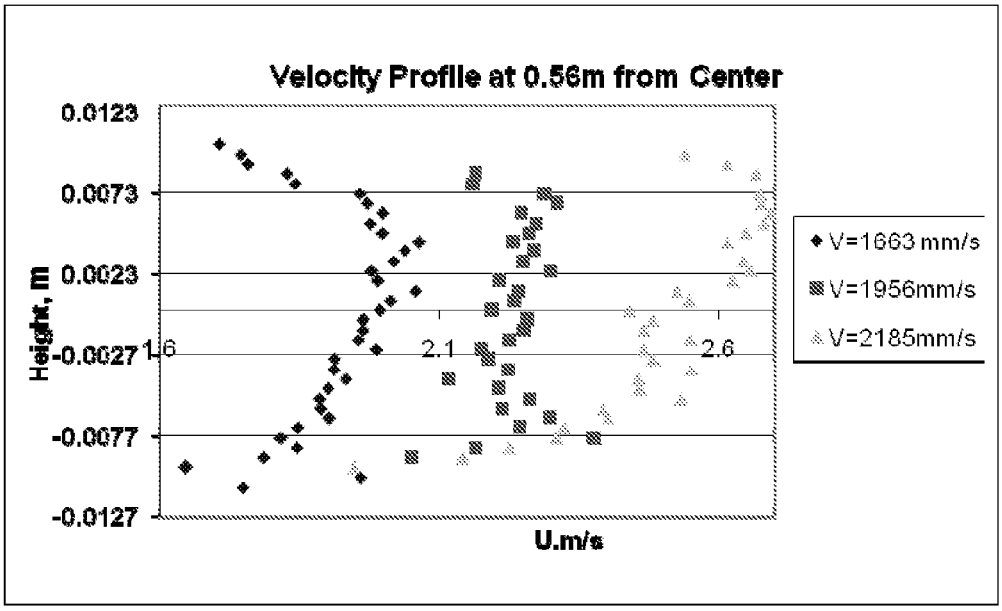
FIG. 26 depicts a perspective view of the tunnel used to test the prototype.

Upon completion of the water tunnel, a series of calibration tests were performed to characterize the flow inside the test section. The first calibration tests were performed with a laser Doppler velocimeter (LDV) to determine the optimal location in which to conduct the experiments. Three locations within the tunnel were chosen ranging from close proximity to the flow straighteners at the entrance of the section to the center of the acrylic test section. Several point velocities were taken along the height of the test section at different flow rates in order to determine the optimal location to test the inlet guide vanes. The results of the tests at 0.56 m from the center, which is closest to the flow straighteners, are shown in FIG. 26. As expected, closest to the flow straighteners, the flow was developing and fluctuation level was high.

Figure 27:
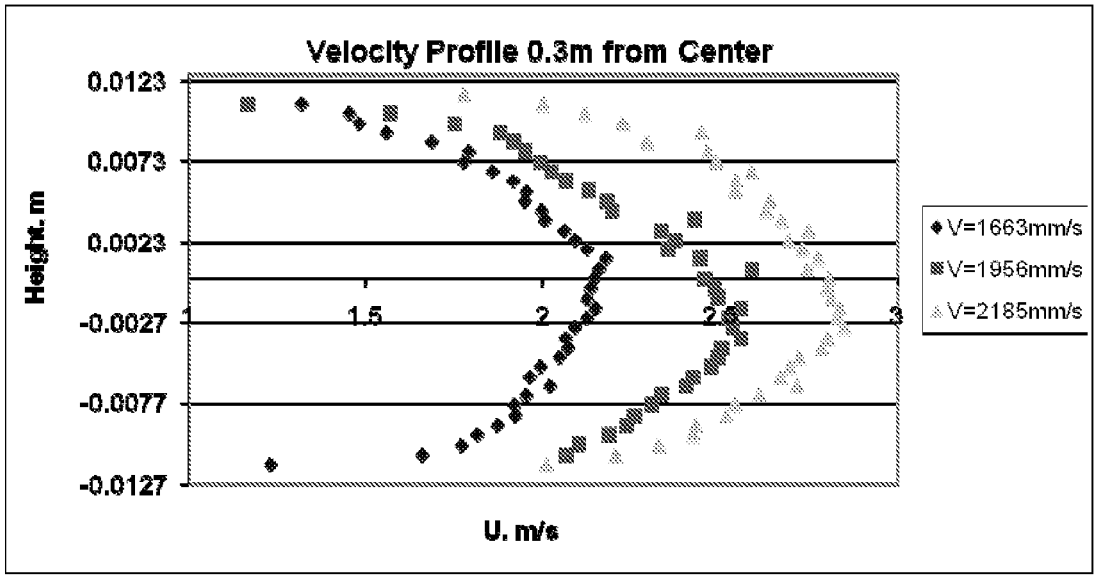
FIGS. 27-29 depict various velocity profiles measured during testing in the tunnel.

The next location was at 0.3 m from the center; results are shown in FIG. 27. Again, the flow confirmed a higher level of velocity fluctuation, thus eliminating this location as a possible experimental location. The last spot tested was at the center of the test section itself. This spot demonstrated the most adequate testing conditions with fully developed and uniform flow at the different flow rates.

Figure 28:
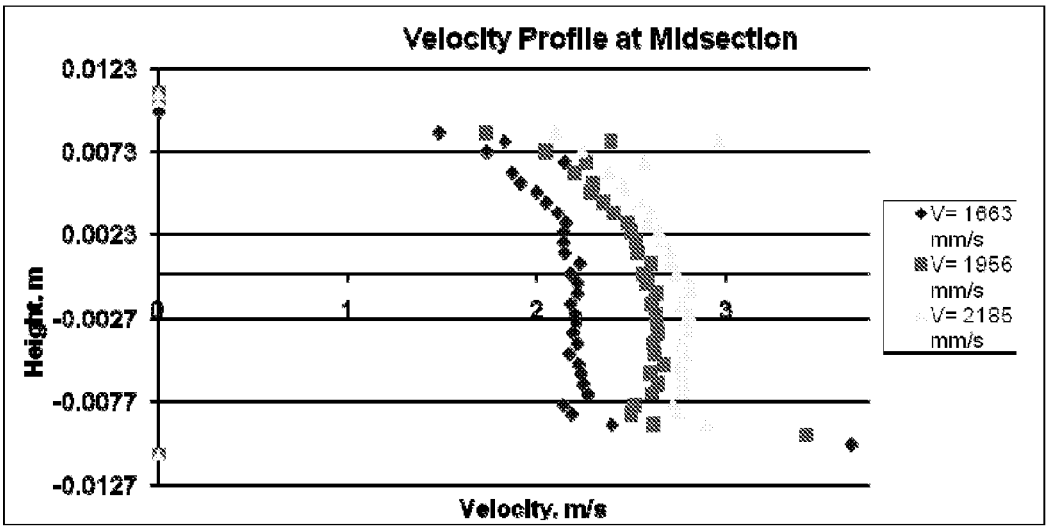
Figure 29:
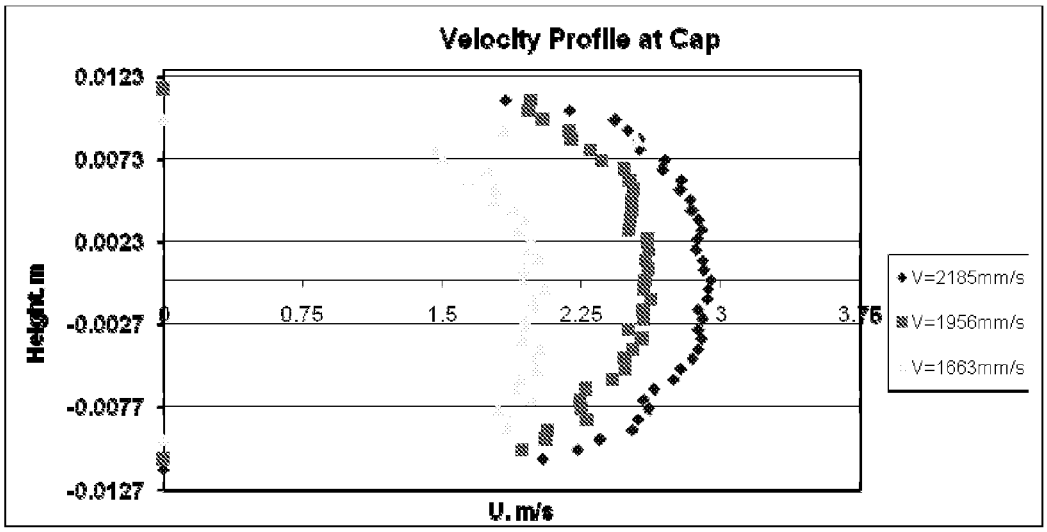

The LDA results for the midsection are shown in FIG. 28. Additional velocity measurements inside the test sections were performed to quantify the effects of test specimen mounting cap and the Pyrex glass pump housing on the quality of the flow. FIG. 29 shows that, inside the test section, the mounting cap effects were minimal on the quality of the flow.

Three velocity planes were taken within the Pyrex tube: rube entrance, mid plane and at the exit. The bulk velocity inside the test section was maintained at 2 m/s. Measured velocity profiles showed a fully developed laminar flow inside the Pyrex housing. The measured velocities at the tube center and the wall were 3.5 m/s and 2.5 m/s, respectively. Planar velocity distributions over the IGV at four locations were measured using Particle Image Velocimetry (PIV). Additional measurements were also done using the LDV. The measurements were then compared with the CFD data. For these experiments the IGV were held in place by the means of the Pyrex casing, which was then placed into the water tunnel by mounting it to the bottom of the test section. The mount was then bolted into place and sealed to prevent leaks.

Figure 30:
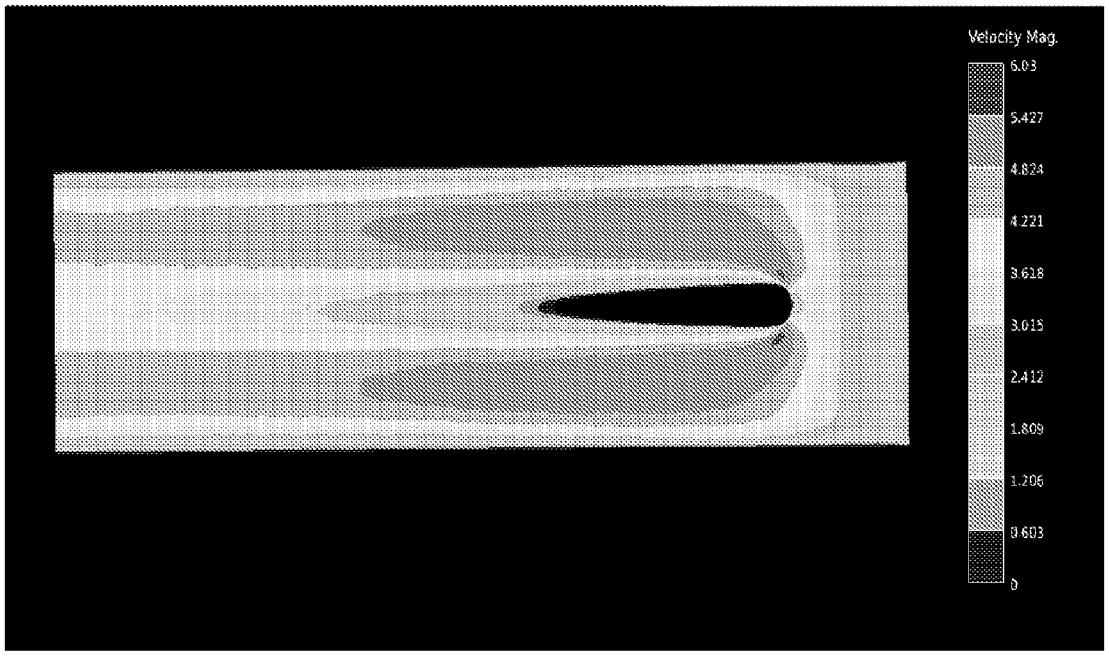
FIG. 30 depicts a CFD modeled velocity contour for a first position relative to an inlet guide vane.

FIG. 30 shows the computed velocity data [from section 5.2.1 above] 0.24 mm from the root of the vane for a constant inlet velocity of 2.412 m/s. The fluid begins to accelerate the closer it gets to the leading edge of the vane. However, a peak velocity of 6.03 m/s is observed as the flow passes over the leading edge. As the fluid encounters the leading edge of the vane, an almost instantaneous deceleration from 3.618 m/s to 0.603 m/s is observed. This occurs again as the fluid approaches the trailing edge of the vane. The flow over the vane's surface has an average velocity of 5.427 m/s concentrated primarily around the center of the flow. As the fluid passes close to the casing wall and the vane's surface, the flow decelerates again rapidly towards 0.603 m/s.

Figure 31:
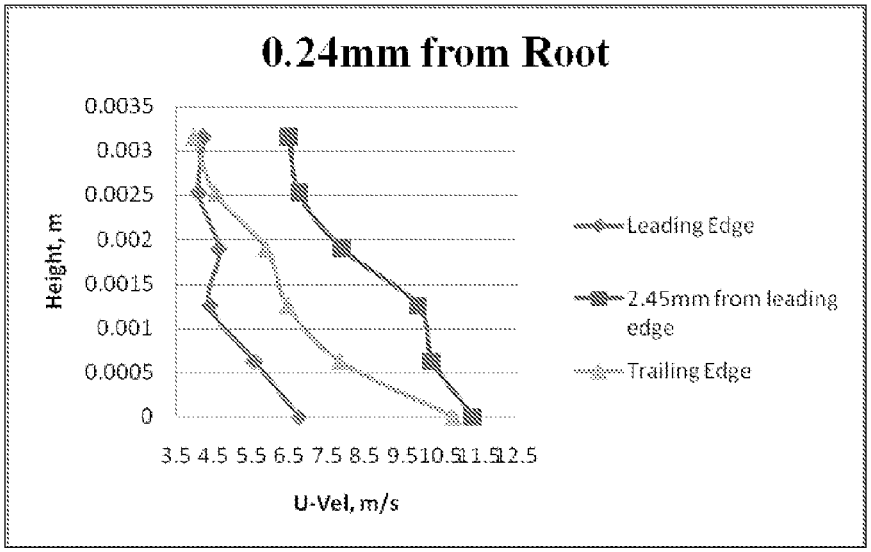
FIGS. 31-32 depict velocity at the first position relative to the inlet guide vane.

FIG. 31 shows the PIV data measured at the same location of the CFD data shown in FIG. 30. Both PIV measurements and CFD contour plots show the maximum velocity at the leading edge and a decrease in the fluid velocity at the casing wall. At the trailing edge of the vane, the velocity of the flow resembles the velocities seen on the CFD plot ranging from 5.5 to 3.5 m/s. However, the velocity of the flow nearest to the vane surface at the trailing edge demonstrates an increase in velocity instead of the almost instantaneous decrease as found in the CFD analysis.

Figure 32:
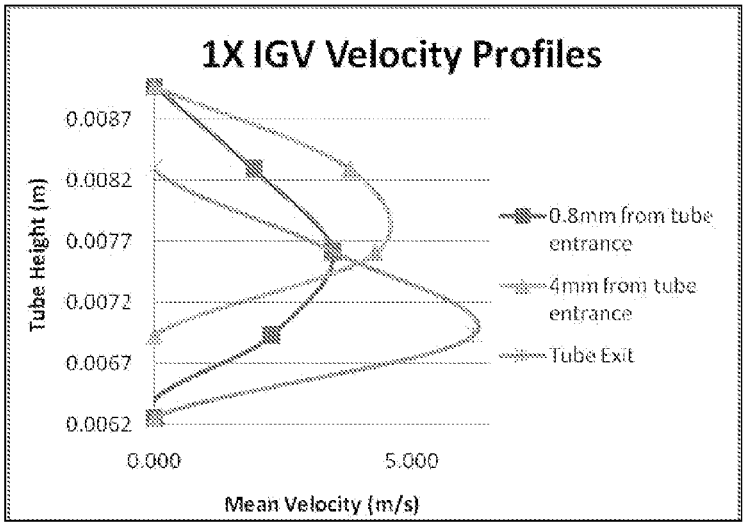

FIG. 32 shows the data acquired using the LDV to analyze the flow over the vane. The LDV results show the same trends that were seen previously in the CFD data. For instance, the flow approaches the vane with a 2 m/s velocity and as the flow passes over the vane, it accelerates to 5 m/s. When the flow approaches the trailing edge of the vane the figure shows that the flow closes to the vane surface increases in velocity to 6 m/s then rapidly decreases to 0 m/s as seen in the CFD plots.

Figure 33:
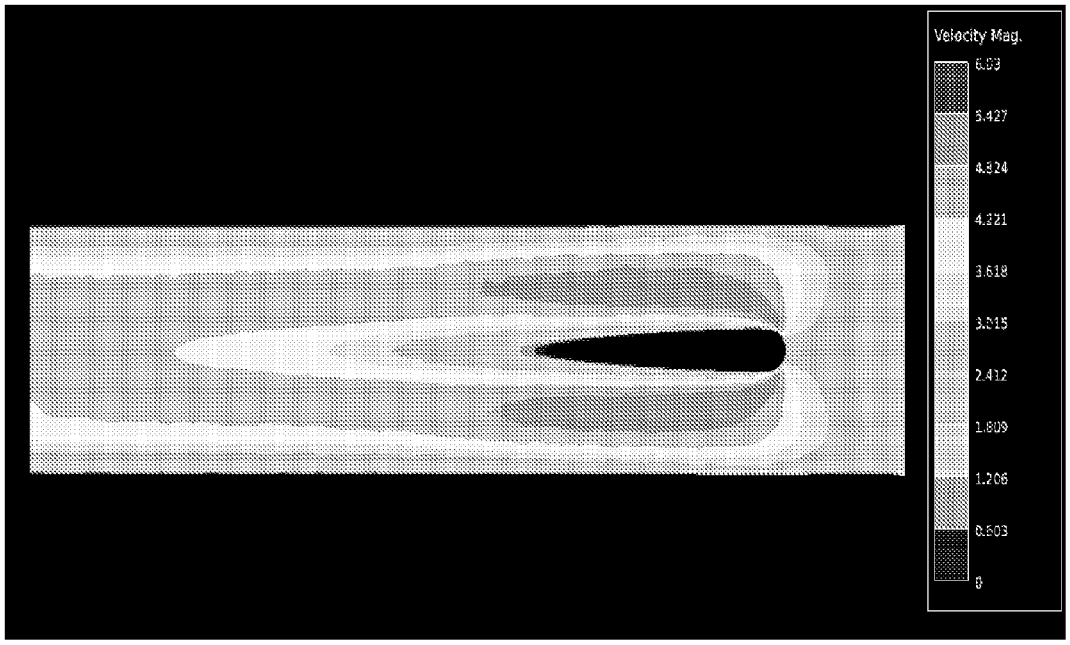
FIG. 33 depicts a CFD modeled velocity contour for a second position relative to an inlet guide vane.
Figure 34:
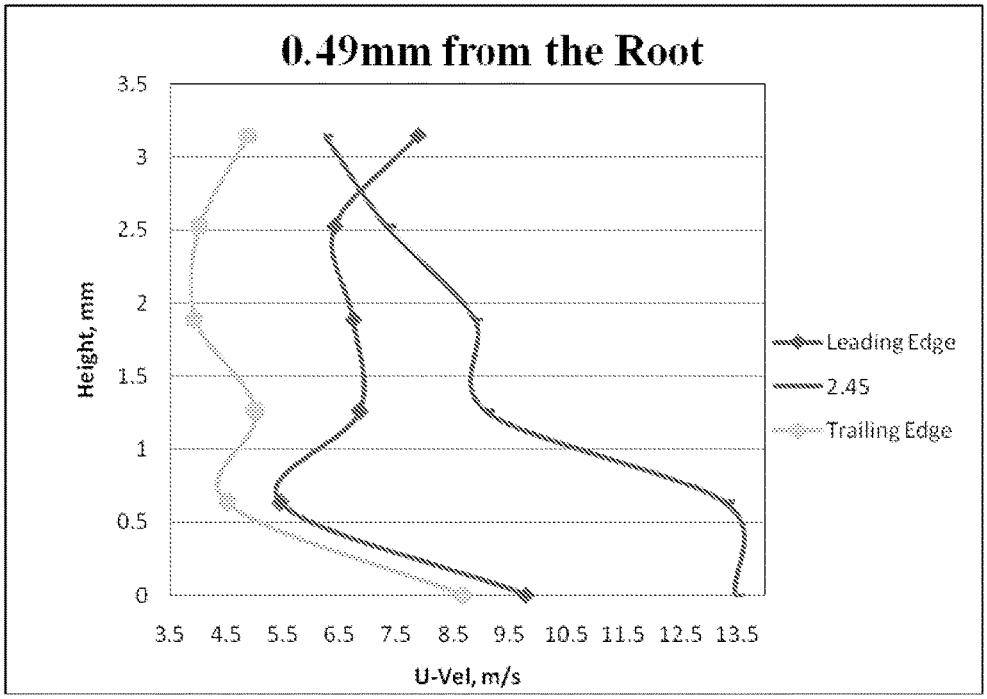
FIGS. 34-35 depict velocity at the second position relative to the inlet guide vane.
Figure 35:
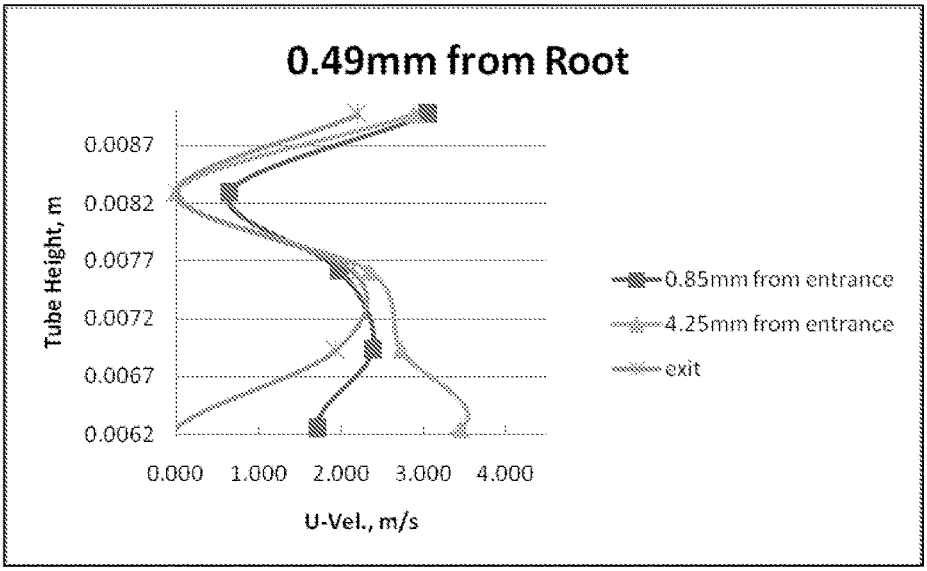

FIG. 33 shows the CFD velocity data at plane 0.49 mm from the root of the vane. FIGS. 34 and 35 show the measured velocity using PIV and LDV at the same location. The flow enters the inlet guide vanes at 2.412 m/s and begins to accelerate to 3 m/s until it reaches the leading edge of the vane. The flow then decelerates at the leading and trailing edges of the vane. As the flow approaches both the vanes surface and the easing wall, the fluid begins to decelerate until it reaches 0.603 m/s. It is interesting to note that the measured velocity at the trailing edge ranges between 3.5 to 4.5 m/s, which is comparable to the CFD calculation shown in FIG. 33. However at the wall, the PIV data shows higher velocities. This is in part due to the reflection of the laser beam at the casing wall.

The LDV data of FIG. 35 shows that close to the inner wall of the casing located at 0.0082 m, the flow varies from 0 to 0.64 m/s which generally agrees with the CFD data. The flow approaches the leading edge at a velocity approximately 2 m/s then it accelerates to 3.5 m/s as it passes over the vanes surface. The flow then decreases to wall velocity as it encounters the trailing edge of the vane. The bulk of the flow is traveling at a range from 2 to 3 m/s unlike the CFD that shows a range of 4 to 5.427 m/s. At this location the LDV measurements show significantly lower velocity in comparison to the CFD data.

Figure 36:
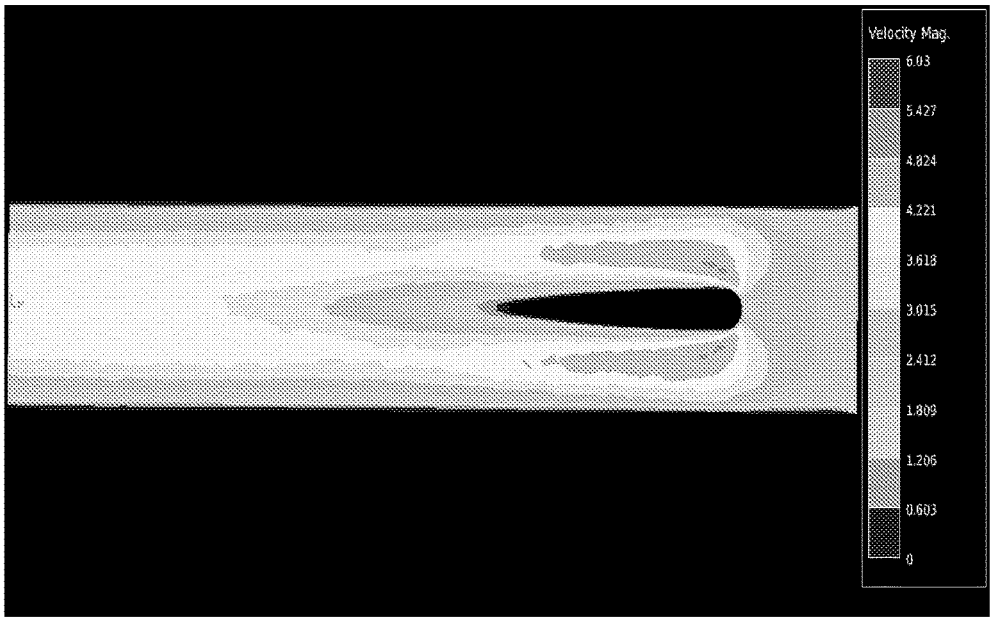
FIG. 36 depicts a CFD modeled velocity contour for a third position relative to an inlet guide vane.
Figure 37:
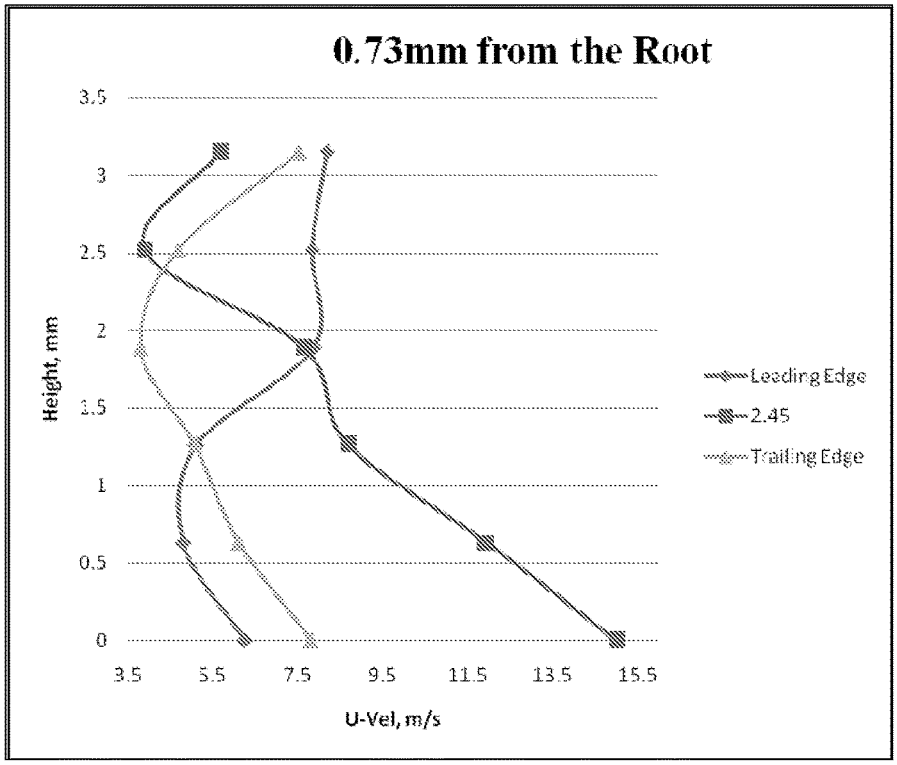
FIGS. 37-38 depict velocity at the third position relative to the inlet guide vane.
Figure 38:
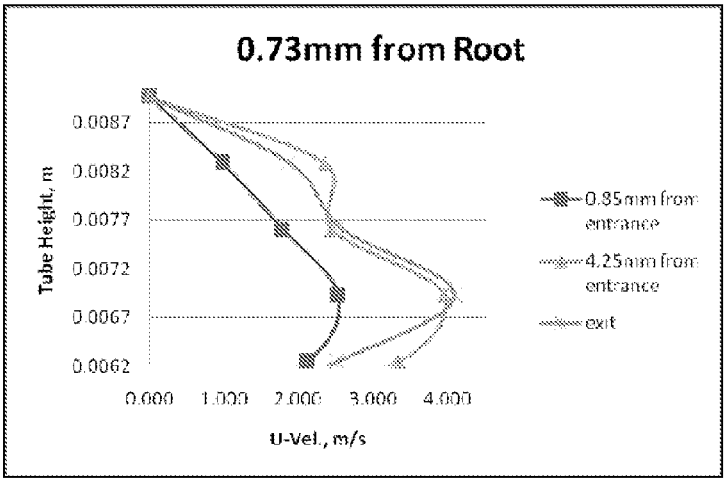

FIG. 36 shows the computed velocity contour at the plane 0.73 mm from the root of the vane. The bulk fluid moves at an average velocity of 4.824 m/s and decelerates to 4.221 m/s as the flow approaches the trailing edge. As seen with the other contours, the flow decelerates around the vanes surface and casing walls to 0.603 m/s. FIGS. 37-38 show the measured velocity at the same location. At this location, actual velocity significantly differs from the CFD data due to increased reflections of laser from the vane wall. However, the LDV data agree fairly well with the computed velocity data.

The benchmarking experiments confirm the computed results. Thus, CFD technique is further used to optimize (in terms of turning angle, vane length and thickness) the pump geometries. However, due to limited capabilities of CFD cavitation models, extensive tests were performed to quantify the cavitation behavior of the pump. The next section describes the cavitation tests of the miniature pump rotor.

5.3 Cavitation Tests

Figure 39:
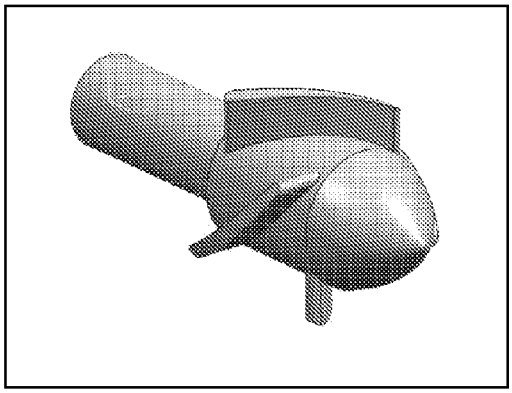
FIG. 39 depicts a perspective view of a rotor used to test rotor performance.

An experimental rotor for the axial flow miniature pump was tested at different rotational speeds to study the cavitation behavior of the rotor design. The rotor is based on the empirical and CFD design methodologies discussed in earlier sections. The details of the methodologies are presented in the next section. FIG. 39 depicts a 3-D CAD drawing of the rotor designed for the cavitation test. The design envelope of the pump required the rotor to maintain cavitation free operation up to 200,000 rpm. A special experimental setup was designed to study cavitation behavior of the miniature rotor. A tank was made of 95.25 cm clear Plexiglas panels with an interior length and width of 20.68 cm and an interior height of 21 cm. Distilled water was used as a surrogate propellant to test the rotor flow dynamics. A 50,000 rpm vibration-free motor was mounted above the tank using a special attachment. The speed of the motor was regulated and controlled within 1000 rpm using a digital motor controller. The control console and tank sat on a Plexiglas base and the motor and vise sat on a Plexiglas cover. For higher rotational speed tests, a pulley-based drive system was used to produce shaft speed in excess of 200,000 rpm.

Figure 40:
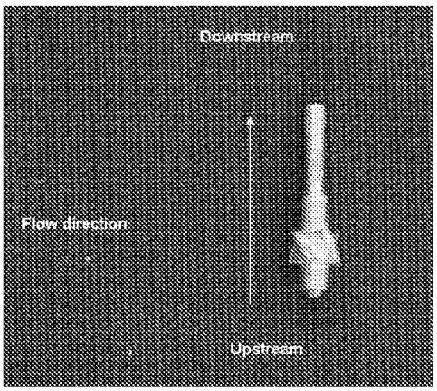
FIG. 40 depicts a photograph of a test rotor.

FIG. 40 shows the test rotor used for the experiment. The base of the rotor extends 0.25 mm axially from the leading and trailing edges of the vanes. A 1 mm diameter and 1 mm length shaft extends from the base of both the upstream and downstream sides. Due to the difficulty of mounting such a small shaft, the tested rotor was machined from aluminum but modified to include a larger, extended shaft on the downstream side. The rotor was attached to a stainless steel shaft and connected to the motor by a chuck. To realistically simulate rotor conditions, a 9 mm Pyrex glass tube with 1 mm wall thickness was used as a pump casing. The glass tube also allowed optical access to the rotor while in operation. The clearance between the rotor tip and glass tube is 0.25 mm. An acrylic tube mounted on the cover was used to hold the glass casing. A 0.95 cm hole was drilled on the side of the acrylic tube to allow the fluid to return to the tank after passing through the test rotor. The rotor, casing, and acrylic tube were submerged in the fluid to a depth of approximately 5 cm.

The rotor was rotated counterclockwise and the fluid flow entered from the bottom through the inlet of the pump casing, continuing upward, and out through the hole in the acrylic tube. A high-speed CCD camera (10,000 fps) was used to record the flow behavior at different rotor speeds. The rotor surface contained ridges due to the limiting resolution of the stepper motor used in the fabrication process. Air bubbles tended to stick to the rotor when it was first submerged into the fluid. This problem was overcome by initially operating the rotor at low speed. In the actual pump prototype, a high surface finish of the rotor was achieved using micro-electropolishing techniques.

In several instances, operating the rotor beyond 30,000 rpm led to eventual failure of the glass casing. The length of time before the casing failed varied depending on the rotor velocity. This was caused by the increased frequency and intensity of the rotor striking the casing due to vibration at higher velocities. The actual pump has a much shorter shaft length and the vibration is minimized through carefully balancing the shaft. The shaft vibration tests are discussed below.

Another interesting experimental observation was bubbles created by the fluid as it was streaming down from the acrylic tube and back into the tank. On occasions, the bubbles would become drawn back into the inlet of the casing. The result was a complete collapse of flow. This only occurred at 45,000 rpm when the fluid cascading down the outside of acrylic tube was sufficiently large enough to create bubbles in the tank. In addition, sufficiently small bubbles posed no threat but could potentially collapse the flow at higher velocities. However, this difficulty provided a special insight to how this miniature pump will respond to an event of an upstream bubble entering into the rotor. This problem leads to a conclusion that the miniature pump may, in some embodiments, benefit from a complete priming prior to starting the pump, at least in part because air bubbles from the upstream sections may cause a significant loss of flow. A mirror-polished surface may also minimize the likelihood of air bubbles sticking to the surfaces of the pump components during the starting phase.

The rotor was tested at 15,000, 30,000, and 45,000 rpm, respectively. The high-speed camera was used to record the results at 125 and 250 fps. During each of the first three tests, the rotor was allowed to reach maximum, steady-state velocity before recording began. A fourth test was conducted in which the transient velocity of the rotor was recorded, in order to develop a throttling response.

5.3.1 Steady State Operation

For the steady state operations, at all rotor speeds no cavitation was detected inside the rotor. However, an increased flow of fluid streamed down the acrylic tube while the rotor operated at 45,000 rpm, creating bubbles in the tank; this was not related to the rotor performance; rather, it was a limitation of the experimental design. On occasions, the bubbles were drawn back into the inlet of the casing. A collapse in flow resulted for sufficiently large air bubbles. As stated earlier this provides an insight of how the rotor would respond in the event of upstream bubble ingestion.

5.3.2 Transient Operation

During transient operation, a resonance frequency was encountered at the range of 7,000 to 9,000 rpm. A noticeable change in angle with the respect to the axial direction was also observed. However, outside of this range, the change in angle was much less noticeable. Similar to steady operations the rotor operated without any cavitation during the transient operation.

6. Vibration Analysis

Several tests were performed in order to determine the extent of the rotor vibration. Unlike the rotor cavitation tests, two fully assembled pumps were used to understand the vibration behavior. The first pump used had a 7 mm long inlet guide vane section with 3 mm outer diameter ball bearings. The second pump had a 5 mm long inlet guide vane with precision 3.97 mm outer diameter ball bearings.

The first test pump was housed in an acrylic casing that had a 9 mm inner diameter; this was done to aide in the visualization of the fluctuation of the pump when operated at 50,000 rpm and beyond using air as the fluid. The tips of the rotor vanes were fluorescently tagged in order to track the displacement using a high speed imaging technique. During the operation, the vibration was noticeable with the naked eye. However, after the test, a closer examination of the pump housing revealed a fluorescent line that was visible all around the casing wall indicating at least a ±1 mm vibration in either direction. In addition, it was noticed that a sizeable percentage of two of the rotor vane tips had been sheared off during the operation. Further vibration testing with this pump revealed no noticeable signs of oscillation. The pump was them modified with shorter inlet guide vane and high precision ball bearings to avoid vibrations.

Figure 41:
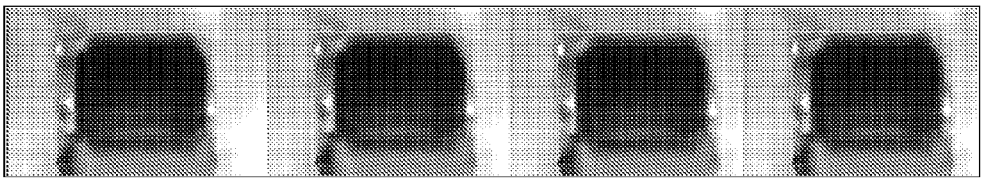
FIG. 41 depicts photographs of a rotor during vibration testing.

The second test pump was then operated with casings being fitted to the inlet guide vanes and the stator for stability purposes. The pump showed insignificant vibration with these modifications. The results of some of the vibration trials are shown in FIG. 41. The images were taken consecutively 0.07 sec apart from one another. It is evident that the vanes did not go past the line, which was drawn to demonstrate the location of the edge of the rotor vanes.

The various illustrative embodiments of the present devices and methods are not intended to be limited to the particular forms disclosed. Rather, they include all modifications and alternatives falling within the scope of the claims. For example embodiments other than the one shown may include some or all of the features of the depicted embodiment.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An axial-flow pump comprising:

a housing having an internal surface defining a channel having an inlet portion and an outlet portion, the channel extending through the housing;

an inlet guide having a body and a plurality of axial vanes extending outward from the body, the inlet guide configured to be coupled in fixed relation to the housing inside the channel;

a stator spaced apart from the inlet guide, the stator having a stator body and a plurality of curved vanes extending outward from the stator body, the stator configured to be coupled in fixed relation to the housing inside the channel closer to the outlet portion than is the inlet guide, the curved vanes each having a concave upstream surface;

a rotor rotatably disposed between the inlet guide and the stator, the rotor having a rotor body and a plurality of curved vanes extending outward from the rotor body that each have a concave downstream surface, the rotor configured to be coupled to a motor or turbine to rotate the rotor relative to the inlet guide and the stator to pump fluid through the channel in a flow direction from the inlet guide toward the stator;

where the pump is configured such that if:

the rotor rotates at 10,000 revolutions per minute (rpm), the pump can pump liquid through the channel at a volumetric flowrate of a unit volume per second, where the unit volume is at least two times the channel volume along the length of the inlet guide, the rotor, and the stator.

2. The pump of claim 1, further comprising a motor or turbine coupled the rotor such that the motor or turbine can be actuated to rotate the rotor.

3. The pump of claim 2, where the pump is configured such that if the rotor rotates at 30,000 rpm, the pump can pump liquid through the channel at a volumetric flowrate of a unit volume per second, where the unit volume is at least twenty times the channel volume along the length of the inlet guide, the rotor, and the stator.

4. The pump of claim 3, where the pump is configured such that if the rotor rotates at 50,000 rpm, the pump can pump liquid through the channel at a volumetric flowrate of a unit volume per second, where the unit volume is at least thirty times the channel volume along the length of the inlet guide, the rotor, and the stator.

5. The pump of claim 1, where the rotor has at least two longitudinally-spaced cross-sectional shapes at which each rotor vane has a surface that is parallel to a radial axis extending from the rotational axis of the rotor in the respective cross-sectional plane.

6. The pump of claim 1, where the stator has at least two longitudinally-spaced cross-sectional shapes at which each stator vane has a surface that is parallel to a radial axis extending from the longitudinal axis of the stator in the respective cross-sectional plane.

7. The pump of claim 1, where the rotor has a maximum transverse dimension of less than 10 millimeters (mm).

8. The pump of claim 7, where the rotor has a maximum transverse dimension of less than or equal to 7 millimeters (mm).

9. The pump of claim 1, further comprising a thruster nozzle coupled to the pump such that the rotor can be rotated to pump fluid through the channel and through the thruster nozzle.

10. The pump of claim 1, where the pump is configured such that if the rotor rotates at 10,000 revolutions per minute (rpm), the pump can generate a pump head of at least 0.12 meters (m) while pumping liquid through the channel at a volumetric flowrate of 1.2 milliliters per second (mL/s).

11. The pump of claim 1, where the inlet guide includes a domed upstream end.

12. The pump of claim 1, where the stator includes a domed downstream end.

13. An axial-flow pump comprising:

a housing having an internal surface defining a channel having an inlet portion and an outlet portion, the channel extending through the housing;

an inlet guide having a body and a plurality of axial vanes extending outward from the body, the inlet guide configured to be coupled in fixed relation to the housing inside the channel;

a stator spaced apart from the inlet guide, the stator having a stator body and a plurality of curved vanes extending outward from the stator body, the stator configured to be coupled in fixed relation to the housing inside the channel closer to the outlet portion than is the inlet guide, the curved vanes each having a concave upstream surface;

a rotor rotatably disposed between the inlet guide and the stator, the rotor having a rotor body and a plurality of curved vanes extending outward from the rotor body that each have a concave downstream surface, the rotor configured to be coupled to a motor or turbine to rotate the rotor relative to the inlet guide and the stator to pump fluid through the channel in a flow direction from the inlet guide toward the stator;

where the pump is configured such that:

the maximum transverse dimension of any of the rotor is less than or equal to 8 millimeters (mm); and if the rotor rotates at 10,000 revolutions per minute (rpm), the pump can pump liquid through the channel at a volumetric flowrate of at least 2 milliliters per second (mL/s).

14. The pump of claim 13, further comprising motor or turbine coupled the rotor such that the motor or turbine can be actuated to rotate the rotor.

15. The pump of claim 14, where the pump is configured such that if the rotor rotates at 30,000 rpm, the pump can pump liquid through the channel at a volumetric flowrate of at least 15 mL/s.

16. The pump of claim 15, where the pump is configured such that if the rotor rotates at 50,000 rpm, the pump can pump liquid through the channel at a volumetric flowrate of at least 25 mL/s.

17. The pump of claim 13, where the rotor has at least two longitudinally-spaced cross-sectional shapes at which each rotor vane has a surface that is parallel to a radial axis extending from the rotational axis of the rotor in the respective cross-sectional plane.

18. The pump of claim 13, where the stator has at least two longitudinally-spaced cross-sectional shapes at which each stator vane has a surface that is parallel to a radial axis extending from the longitudinal axis of the stator in the respective cross-sectional plane.

19. The pump of claim 13, further comprising a thruster nozzle coupled to the pump such that the rotor can be rotated to pump fluid through the channel and through the thruster nozzle.

20. The pump of claim 13, where the pump is configured such that if the rotor rotates at 10,000 revolutions per minute (rpm), the pump can generate a pump head of at least 0.12 meters (m) while pumping liquid through the channel at a volumetric flowrate of 1.2 milliliters per second (mL/s).

21. The pump of claim 13, where the inlet guide includes a domed upstream end.

22. The pump of claim 13, where the stator includes a domed downstream end.

* * * * *